US009712905B2

(12) United States Patent
Zorkendorfer et al.

(10) Patent No.: US 9,712,905 B2
(45) Date of Patent: Jul. 18, 2017

(54) HEADSETS WITH NON-OCCLUDING EARBUDS

(75) Inventors: Rico Zorkendorfer, San Francisco, CA (US); Julian Hoenig, San Francisco, CA (US); Jonathan Aase, Redwood City, CA (US); Kurt Stiehl, Cupertino, CA (US); Phillip Michael Hobson, Menlo Park, CA (US); Eric Wang, Redwood City, CA (US); Ian Davison, Cupertino, CA (US)

(73) Assignee: APPLE INC., Cupertino, CA (US)

( * ) Notice: Subject to any disclaimer, the term of this patent is extended or adjusted under 35 U.S.C. 154(b) by 0 days.

(21) Appl. No.: 13/607,551

(22) Filed: Sep. 7, 2012

(65) Prior Publication Data

US 2013/0343595 A1 Dec. 26, 2013

Related U.S. Application Data

(63) Continuation-in-part of application No. 13/528,550, filed on Jun. 20, 2012, now Pat. No. 8,976,994, and a continuation-in-part of application No. 13/528,566, filed on Jun. 20, 2012, now Pat. No. 8,971,561.

(51) Int. Cl.

| | |
|---|---|
| ***H04R 25/00*** | (2006.01) |
| ***H04R 1/10*** | (2006.01) |
| *H04R 1/28* | (2006.01) |

(52) U.S. Cl.

CPC ..... *H04R 1/10* (2013.01); *H04R 1/1016* (2013.01); *H04R 1/2811* (2013.01); *H04R 2201/10* (2013.01)

(58) Field of Classification Search

USPC ..... 381/370, 374

See application file for complete search history.

(56) References Cited

U.S. PATENT DOCUMENTS

| | | | |
|---|---|---|---|
| 3,064,715 | A | 11/1962 | Bland |
| 4,742,887 | A | 5/1988 | Yamagishi |
| 5,119,457 | A | 6/1992 | Callahan |
| 5,298,692 | A | 3/1994 | Ikeda et al. |

(Continued)

FOREIGN PATENT DOCUMENTS

| | | |
|---|---|---|
| EP | 0448110 | 9/1991 |
| EP | 1879424 | 1/2008 |

(Continued)

*Primary Examiner* — Amir Etesam

(74) *Attorney, Agent, or Firm* — Van Court & Aldridge LLP

(57) ABSTRACT

Headsets with non-occluding earbuds are disclosed. The earbud includes a non-occluding housing having a directional sound port offset with respect to a center axis of the earbud. The housing can have an asymmetric shape amenable to in-the-ear retention. Additionally, the housing can have a seamless or nearly seamless construction even though two or more parts are joined together to form the housing. Front and back volumes can exist for a driver of the earbud, and embodiments of this invention use mid-mold and rear-mold structures to achieve desired performance from the earbud. For example, the mid-mold structure can be used to tune the front volume while the rear-mold structure can be used to tune the back volume. Apertures may also be included in the housing to further improve the performance of the earbud.

28 Claims, 18 Drawing Sheets

(56) References Cited

U.S. PATENT DOCUMENTS

| | | | | |
|---|---|---|---|---|
| 5,949,896 | A | 9/1999 | Nageno et al. | |
| 6,668,064 | B1 | 12/2003 | Lin | |
| 6,807,740 | B2 | 10/2004 | Reed et al. | |
| 6,849,799 | B2 | 2/2005 | Springer et al. | |
| 7,356,156 | B2 * | 4/2008 | Regg | H04R 1/1066 381/374 |
| 7,634,099 | B2 | 12/2009 | Harvey et al. | |
| 7,916,888 | B2 | 3/2011 | Sapiejewski et al. | |
| 7,971,338 | B2 | 7/2011 | Yang et al. | |
| 8,532,325 | B2 * | 9/2013 | Tung et al. | 381/380 |
| 8,559,665 | B2 * | 10/2013 | Schmidt et al. | 381/374 |
| 8,565,467 | B1 * | 10/2013 | Tseng | 381/373 |
| 8,594,351 | B2 * | 11/2013 | Harlow et al. | 381/309 |
| 8,873,790 | B2 | 10/2014 | Hayashida et al. | |
| 8,971,561 | B2 | 3/2015 | Howes et al. | |
| 8,976,994 | B2 | 3/2015 | Howes et al. | |
| 2001/0040044 | A1 | 11/2001 | Tabaddor et al. | |
| 2004/0055780 | A1 | 3/2004 | Hakkarainen et al. | |
| 2006/0140434 | A1 * | 6/2006 | Yang | 381/380 |
| 2007/0154050 | A1 * | 7/2007 | Kim | 381/382 |
| 2007/0159278 | A1 | 7/2007 | Aemisegger | |
| 2007/0189570 | A1 | 8/2007 | Matsuo et al. | |
| 2008/0013774 | A1 | 1/2008 | Hosaka et al. | |
| 2008/0019554 | A1 | 1/2008 | Krywko | |
| 2008/0166007 | A1 | 7/2008 | Hankey et al. | |
| 2009/0041281 | A1 | 2/2009 | Chang | |
| 2009/0116676 | A1 | 5/2009 | Welsh et al. | |
| 2009/0123010 | A1 | 5/2009 | Cano et al. | |
| 2009/0147981 | A1 | 6/2009 | Blanchard et al. | |
| 2010/0095501 | A1 | 4/2010 | Yoshioka et al. | |
| 2011/0081034 | A1 | 4/2011 | Tung et al. | |
| 2011/0088925 | A1 | 4/2011 | Tatsumi et al. | |
| 2011/0189876 | A1 | 8/2011 | Schneider | |
| 2012/0076341 | A1 | 3/2012 | Ozawa | |
| 2013/0037320 | A1 | 2/2013 | Harwath et al. | |
| 2013/0136290 | A1 | 5/2013 | Huang et al. | |

FOREIGN PATENT DOCUMENTS

| | | |
|---|---|---|
| JP | 62-141293 | 9/1987 |
| JP | H08-172691 | 7/1996 |
| JP | 2011-159626 | 8/2011 |
| JP | 2011-182201 | 9/2011 |
| KR | 1992-0007601 | 10/1992 |
| TW | M426234 | 4/2012 |

* cited by examiner

HEADSETS WITH NON-OCCLUDING EARBUDS

CROSS-REFERENCE TO RELATED APPLICATION

This application is a continuation-in-part of application Ser. No. 13/528,550, filed Jun. 20, 2012, and also a continuation-in-part of application Ser. No. 13/528,566, filed Jun. 20, 2012, the disclosures of which are incorporated by reference herein in their entireties.

BACKGROUND

This disclosure is directed to headsets with non-occluding earbuds and methods for making the same.

Headsets are commonly used with many portable electronic devices such as portable media players and mobile phones. Headsets can include one or more cables as well as various non-cable components such as a jack, headphones, and/or a microphone. The one or more cables can interconnect the non-cable components. The headphones, which are the components that generate sound, can exist in different form factors such as over-the-ear headphones, in-the-ear earbuds, or in-the-canal earbuds. In-the-ear earbuds are sometimes referred to as non-occluding earbuds as they generally do not form an airtight seal with a user's ear.

Conventional non-occluding earbuds come with some drawbacks, however. Exposure to normal use can easily cause damage to the earbuds and they may not function properly as a result of the damage. For example, exerting a force on a housing of the earbuds may crack the housing or abruptly pulling on a cable of the earbuds may separate the cable from the earbuds. As another example, exposing the earbuds to external chemicals (e.g., sunscreen) may compromise the structural integrity of the earbuds and cause them to break more easily. In addition to the potential for damage during normal use, the absence of an airtight seal can affect the earbuds' acoustic performance. As a result, the sound quality of non-occluding earbuds may suffer compared to other types of headphones.

Accordingly, there is a need for improved non-occluding earbuds that are better able to withstand the rigors of normal use, provide high quality sound, and have an aesthetically pleasing appearance.

SUMMARY

Headsets with non-occluding earbuds and methods for making the same are disclosed. The earbud includes a non-occluding housing having a directional sound port offset with respect to a center axis of the earbud. The housing can have an asymmetric shape amenable to in-the-ear retention. Additionally, the housing can have a seamless or nearly seamless construction even though two or more parts are joined together to form the housing. Front and back volumes can exist for a driver of the earbud, and embodiments of this invention use mid-mold and rear-mold structures to achieve desired performance from the earbud. For example, the mid-mold structure can be used to tune the front volume while the rear-mold structure can be used to tune the back volume. Apertures may also be included in the housing to further improve the performance of the earbud.

According to a particular embodiment, an earbud can include a cap, a rear housing, a mid-mold, a driver, and a rear-mold. The mid-mold may be secured to an inner surface of the cap. The driver may be mounted to the mid-mold. The rear housing may be coupled to the cap such that the rear housing and cap provide a clearance fit with the driver to hold it in place. The rear-mold may be secured to an inner surface of the rear housing.

According to another particular embodiment, there is provided a tail plug for acoustically sealing a tail portion of an earbud. The tail plug can include a skeleton member and a sealing member. The skeleton member may be constructed from a rigid material and the sealing member may be constructed from a compliant material. The sealing member may be coupled to a bottom portion of the skeleton member.

According to yet another embodiment, there is provided a terminator operative to serve as the termination point for an earbud cable. The terminator can include a molded structure defining a cavity and an opening for accessing an end of the earbud cable.

BRIEF DESCRIPTION OF THE DRAWINGS

The above and other features of the present invention, its nature and various advantages will be more apparent upon consideration of the following detailed description, taken in conjunction with the accompanying drawings in which.

DETAILED DESCRIPTION

Non-occluding earbuds and methods for making the same are described below with reference to FIGS. 1-23. Earbuds according to embodiments of this invention include a non-occluding housing having a directional sound port offset with respect to a center axis of the earbud. The housing can have an asymmetric shape amenable to in-the-ear retention, but does not form an airtight seal with the user's ear or ear canal. The absence of an airtight seal may require that volumes within the earbud be specifically tuned (e.g., by specifically shaping the volumes and/or adding material to the volumes) to achieve a desired frequency response. In addition, secondary apertures in the earbud may be further required to achieve desired sound performance. For example, a secondary aperture may serve as a controlled leak port to expose an acoustic pressure within the earbud to the external, surrounding environment. In this aspect, the secondary aperture may be calibrated to modify an acoustic response of the earbud.

Embodiments of this invention use a mid-mold structure within the housing to form a portion of a front volume for a driver (e.g., a speaker) of the earbud. The mid-mold may be fixed to an inner surface of the housing and can have its internal cavity shaped to provide a desired front volume for the driver, regardless of the shape of the housing. Embodiments of this invention also use a rear-mold structure within the housing to form a portion of a back volume for the driver of the earbud. The rear-mold may be fixed to an inner surface of the housing and can have its internal cavity shaped to provide a desired back volume for the driver, regardless of the shape of the housing. The rear-mold can be dimensioned to tune a frequency response and improve a bass response of the earphone. For example, the size and shape of the back volume may be dimensioned to achieve a desired frequency response of the earbud. The rear-mold structure can also serve as the termination point of the earbud cable. In addition, earbuds according to embodiments of this invention can be constructed to have a seamless finish even though two or more parts are joined together to form part of the earbud. As will be explained in more detail below, to achieve the seamless finish, the earbuds can be constructed using a zero gap/offset methodology.

Figure 1A:
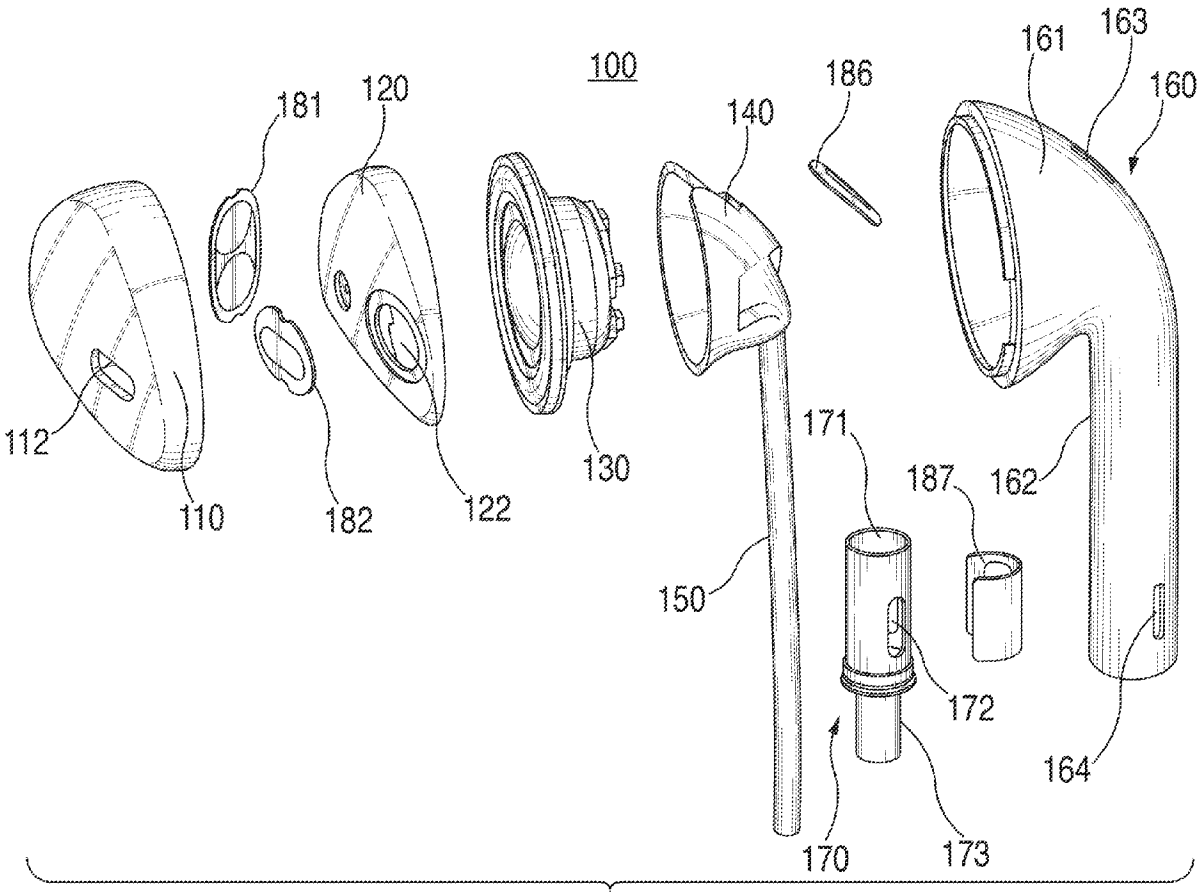
FIG. 1A shows an exploded view of an illustrative earbud in accordance with an embodiment of the invention.
Figure 1C:
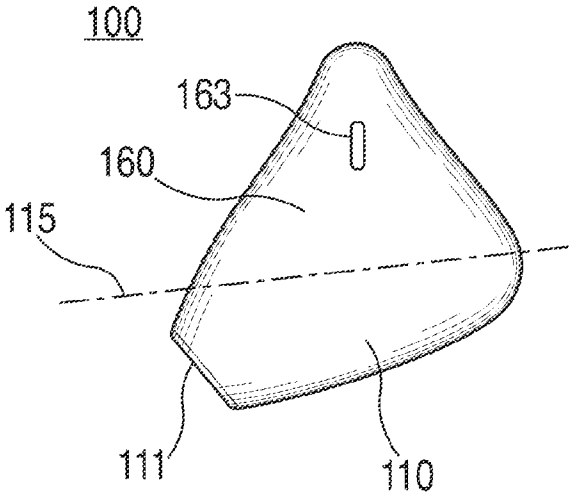
FIG. 1C shows a perspective top view of the illustrative earbud of FIG. 1A in accordance with an embodiment of the invention.
Figure 1B:
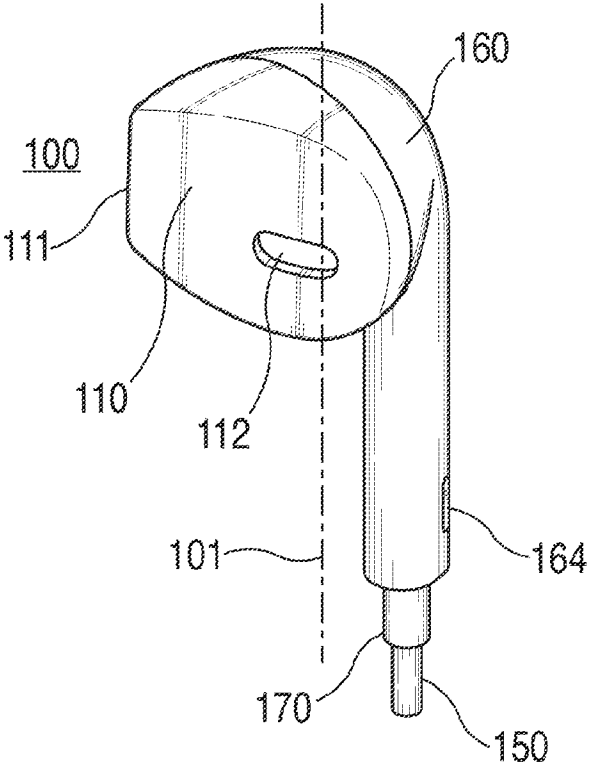
FIG. 1B shows a perspective front view of the illustrative earbud of FIG. 1A in accordance with an embodiment of the invention.

FIGS. 1A-1C show several illustrative views of earbud 100 in accordance with an embodiment of the invention. In particular, FIG. 1A shows an exploded view, FIG. 1B shows a front view, and FIG. 1C shows a top view of earbud 100. Earbud 100 is a non-occluding earbud, and may be included as part of a headset for a portable media player or mobile phone. Non-occluding earbuds are generally designed not to form an airtight seal between the ear (or ear canal) and the outer surface of the earbud. By way of contrast, occluding earbuds are generally designed to fit inside of the user's ear canal and form a substantially airtight seal. Earbud 100 can include cap 110, driver seat 120, driver 130, terminator 140, cable 150, rear housing 160, and tail plug 170.

As shown, earbud 100 is asymmetrically shaped along at least two orthogonal axes. Directional sound port 111 is positioned offset with respect to center axis 101. Directional sound port 111 may be offset such that when earbud 100 is placed in a user's ear, port 111 is positioned to direct sound directly into the user's ear canal.

In addition to directional sound port 111, the housing of earbud 100 (i.e., cap 110 and rear housing 160) may also include several apertures. For example, earbud 100 includes front leak 112, back vent 163, and bass ports 164 (although only one bass port 164 is shown). It is understood that earbud 100 can include just one bass port 164, and in other embodiments, it can include two or more bass ports 164. These apertures can provide venting for driver 130 and can help to tune the frequency response of earbud 100 over certain frequency ranges. As an example, the size and shape of front leak 112 may be selected to achieve an amount of air leakage found acoustically desirable and that can be consistently maintained not only each time the same user wears the earphone but also between users. Each aperture in the housing of earbud 100 may be designed to provide specific performance. In other words, each aperture is not just a random opening, but instead has been intentionally formed for a particular purpose, namely to change the frequency response of earbud 100 in a way that helps to tune the frequency response and/or provide a consistent bass response amongst the same user and across users. A more detailed explanation of acoustic ports can be found, for example, in U.S. patent application Ser. No. Publication No. 2013/0343594.

Internal components of earbud 100 may have apertures that align with the apertures of cap 110 and rear housing 160. For example, driver seat 120 may include aperture 122 aligned with front leak 112 and tail plug 170 may include apertures 172 aligned with bass ports 164. Earbud 100 can also include various meshes (e.g., snorkel mesh 181, front leak mesh 182, back vent mesh 186, and bass port mesh 187) that cover or fit into a corresponding aperture of earbud 100.

As shown in FIGS. 1B and 1C, earbud 100 can be constructed to have a seamless housing even though two or more parts are joined together to form part of the earbud. For example, cap 110 and rear housing 160 can be coupled together to provide a substantially seamless housing for earbud 100. Once cap 110 and rear housing 160 are mated along plane 115, substantially no offset or gap exists between the two. As a result, the housing of earbud 100 may appear to have a single piece construction. Two-part construction of the housing of earbud 100 may be necessary in order to accommodate the installation of various internal components (e.g., driver seat 120, driver 130, and terminator 140).

A mid-mold structure may be included within earbud 100 to serve several purposes. For example, driver seat 120 is included as part of earbud 100 to help seat driver 130 and form a portion of a front volume for driver 130. Driver seat 120 may be fixed to an inner surface of cap 110 using any suitable method (e.g., using glue), and may be formed from any suitable material, for example, driver seat 120 may be formed from plastic. Driver seat 120 can be constructed to provide a front volume of any predetermined size, regardless of the shape of cap 110. As such, driver seat 120 can aid with the acoustical tuning of earbud 100. For example, driver seat 120 may occupy a majority of the volume of cap 110 in order to improve the high end frequency response of earbud 100. Driver seat 120 can also aid with mesh retention. Snorkel mesh 181 and front leak mesh 182 may be coupled to cap 110 in any suitable manner (e.g., using an adhesive). Driver seat 120 can provide additional support to snorkel mesh 181 and front leak mesh 182 to keep them pressed against cap 110 and prevent them from being pushed inwards.

A rear-mold structure may also be included within earbud 100. For example, terminator 140 is included as part of earbud 100 to form a portion of a back volume for driver 130. Terminator 140 may be fixed to an inner surface of rear housing 160 using any suitable method (e.g., using glue), and may be formed from any suitable material, for example, terminator 140 may be formed from plastic. Terminator 140 can be constructed to provide a back volume of any predetermined size, regardless of the shape of rear housing 160. As such, terminator 140 can aid with the acoustical tuning of earbud 100. For example, terminator 140 may tune mid-band acoustics of earbud 100. A more detailed explanation of the acoustic tuning properties of rear-molds can be found, for example, in U.S. Publication No. 2013/0343593.

Terminator 140 may be overmolded over a knot (not shown) in one end of cable 150 and effectively terminates cable 150. The design and implementation of terminator 140 provides enhanced durability of earbud 100. For example, terminator 140 provides earbud 100 with an increased ability to withstand abrupt pulling of cable 150 relative to the housing of earbud 100. As used herein, the term "abrupt pull" is intended to refer to a sudden force applied to one component relative to another component. An abrupt pull may result in the separation of one component from another and may ultimately cause damage that prevents the component from functioning as intended. As a result of including terminator 140, earbud 100 may be able to withstand both a greater number and larger magnitude of abrupt pull events on cable 150.

Tail plug 170 may be included as part of earbud 100 in order to acoustically seal tail 162 of rear housing 160. By acoustically sealing tail 162, tail plug 170 ensures that when driver 130 is operating, air from behind driver 130 is forced down tail 162 and out through bass ports 164 of rear housing 160. Tail plug 170 may be fixed to rear housing 160 using any suitable method. For example, glue may be used to fix skeleton 171 to an inner surface of rear housing 160. Tail plug 170 may have a two-part construction including skeleton 171 and sealing member 173. Skeleton 171 and sealing member 173 may be coupled together using any suitable method, for example, they may be coupled using a chemical bond and/or an interference fit. Skeleton 171 may be constructed of a rigid material (e.g., metal) while sealing member 173 may be formed from a pliable material that is operative to create a seal with tail 162 (e.g., silicone). Skeleton 171 may include apertures 172 that align with bass ports 164 to provide an unobstructed pathway for air to escape from rear housing 160 via bass ports 164. Bass port mesh 187 may be fixed to skeleton 171 in any suitable manner (e.g., using an adhesive) and skeleton 171 can hold bass port mesh 187 in place against an inner surface of rear housing 160.

Earbud 100 can include three sub-assemblies: a cap sub-assembly, which includes cap 110, driver seat 120, driver 130, and meshes 181 and 182; a rear housing sub-assembly, which includes rear housing 160, tail plug 170, and meshes 186 and 187; and a cable sub-assembly, which includes terminator 140 and cable 150. Although the elements of earbud 100 are described in terms of three sub-assemblies for convenience, it is understood that this grouping of elements is arbitrary and does not imply any inherent limitations of the individual elements.

Figure 2:
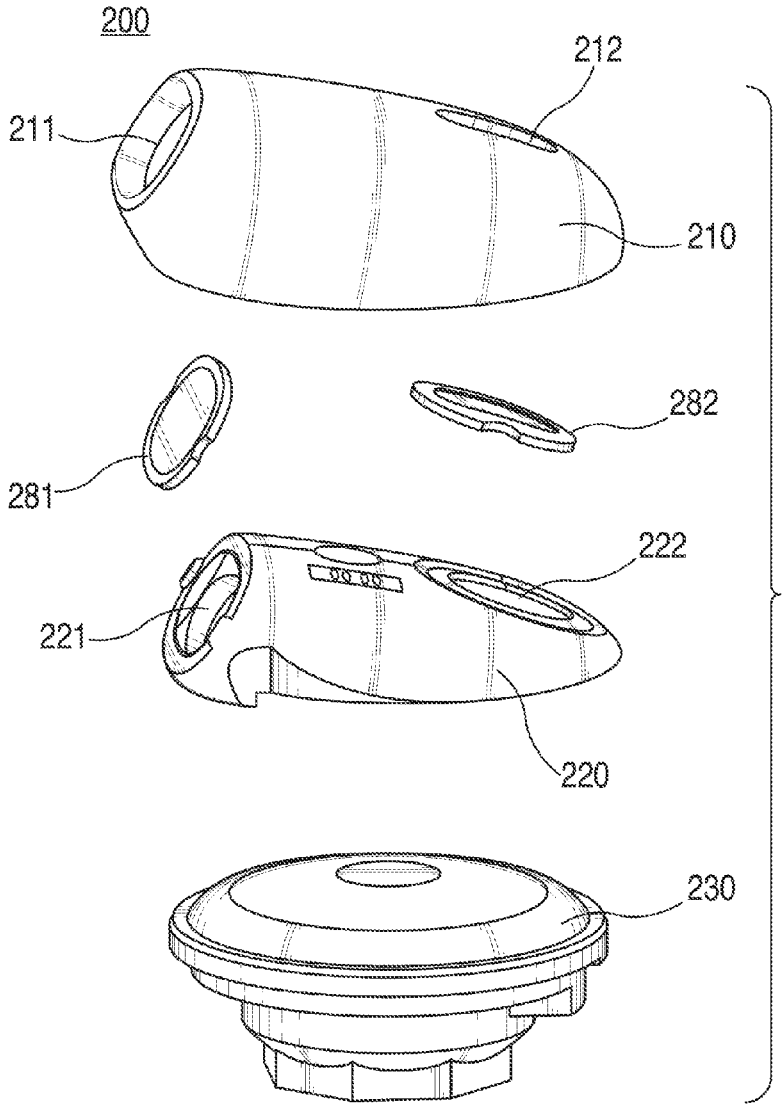
FIG. 2 shows an exploded view of an illustrative cap sub-assembly in accordance with an embodiment of the invention.
Figure 3B:
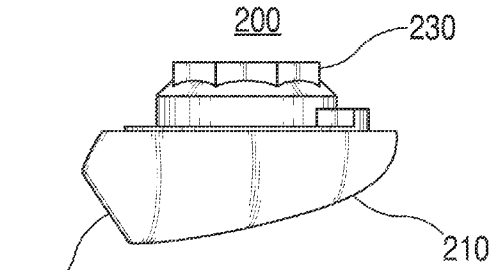
FIG. 3B shows a perspective side view of the cap sub-assembly of FIG. 2 in accordance with an embodiment of the invention.
Figure 3C:
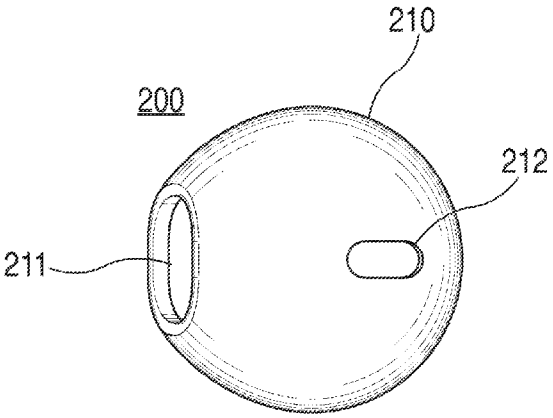
FIG. 3C shows a perspective top view of the cap sub-assembly of FIG. 2 in accordance with an embodiment of the invention.
Figure 3A:
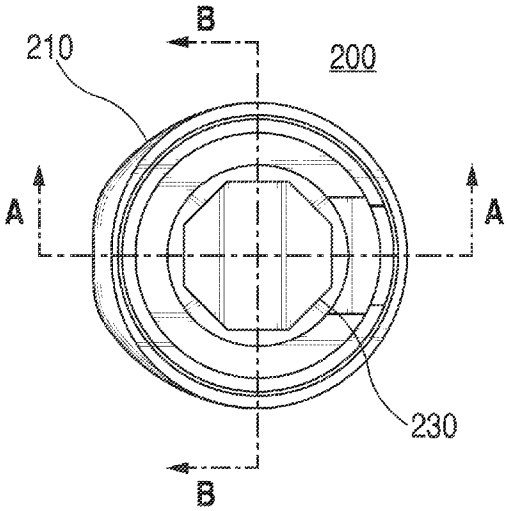
FIG. 3A shows a perspective bottom view of the cap sub-assembly of FIG. 2 in accordance with an embodiment of the invention.
Figure 4B:
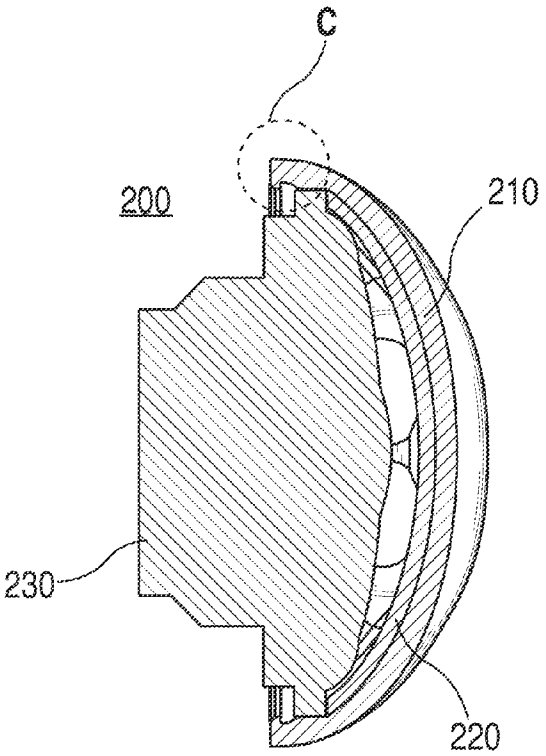
FIG. 4B shows a cross-sectional view of the cap sub-assembly of FIG. 3A, taken from line B-B of FIG. 3A, in accordance with an embodiment of the invention.
Figure 4A:
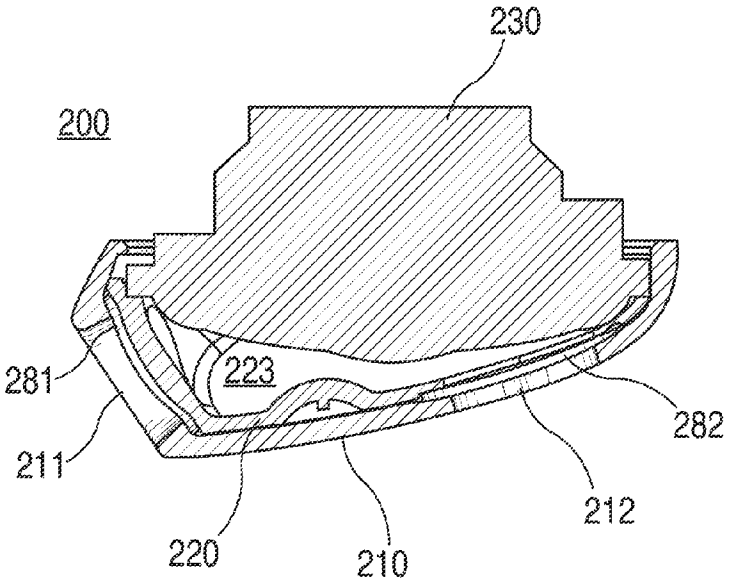
FIG. 4A shows a cross-sectional view of the cap sub-assembly of FIG. 3A, taken from line A-A of FIG. 3A, in accordance with an embodiment of the invention.
Figure 4C:
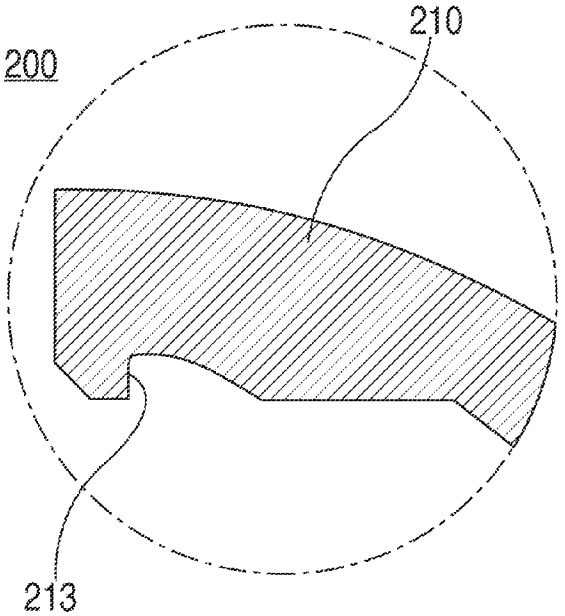
FIG. 4C shows a partial cross-sectional view of the cap sub-assembly of FIG. 4B, showing a magnified view of section C from FIG. 4B in accordance with an embodiment of the invention.

FIGS. 2-4C show various views of illustrative cap sub-assembly 200 in accordance with some embodiments of the invention. In particular, FIG. 2 shows an exploded view of cap sub-assembly 200, FIG. 3A shows a perspective bottom view of cap sub-assembly 200, FIG. 3B shows a perspective side view of cap sub-assembly 200, FIG. 3C shows a perspective top view of cap sub-assembly 200, FIG. 4A shows a cross-sectional view of cap sub-assembly 200, taken from line A-A of FIG. 3A, FIG. 4B shows a cross-sectional view of cap sub-assembly 200, taken from line B-B of FIG. 3A, and FIG. 4C shows a partial cross-sectional view of cap sub-assembly 200, showing a magnified view of section C from FIG. 4B. Cap sub-assembly 200 may include cap 210, driver seat 220, driver 230, snorkel mesh 281, and front leak mesh 282. The elements of cap sub-assembly 200 may be substantially the same as similarly-numbered elements of earbud 100, and elements of FIGS. 2-4C may have some or all features as similarly-numbered elements of FIG. 1.

Cap sub-assembly 200 may include cap 210, which can serve as a housing for the remaining components of cap sub-assembly 200. Cap 210 may be formed in any suitable manner and may be made from any suitable material. For example, cap 210 may be molded from plastic. Cap 210 may include directional sound port 211, which serves as the primary pathway for sound waves created by driver 230. Directional sound port 211 may be designed to direct the sound waves directly into a user's ear canal. Cap 210 may also include front leak 212. The placement and size of front leak 212 may be chosen based on acoustic considerations. For example, front leak 212 may be designed such that it provides proper venting for driver 230 and/or such that it tunes a particular frequency range. For example, front leak 212 can affect performance of the higher frequency portion of the frequency response. As a specific example, for a given earbud with a particularly tuned acoustic profile, the larger the size of front leak 212, the greater the performance of the higher frequency portion. Cap 210 may include features that help it mate with a corresponding rear housing (e.g., rear housing 160 of FIG. 1) to form an external enclosure. As shown in FIG. 4C, cap 210 may include snap 213, which is operative to couple with a snap on a rear housing.

The size, shape, and position of front leak 212 can be selected to achieve a desired frequency response for a relatively large sample size of the general population. The position of front leak 212 is such that it minimizes the chance it touches the inside of a user's ear. Thus, front leak 212 is designed to leak within the user ear. The shape and size of front leak 212 can assist in mitigating such touching. For example, as shown, front leak 212 has a oblong shape or oval-like shape (i.e., longer than it is wide). Such a shape can decrease the probability of full coverage.

Cap sub-assembly 200 may also include driver seat 220. Diver seat 220 is a mid-mold structure that can seat driver 230 in a desired position. Driver seat 220 may be fixed to an inner surface of cap 210 (e.g., using glue) and has a cavity to provide front volume 223 for driver 230. Driver seat 220 can be constructed to provide front volume 223 of any predetermined size and shape, regardless of the shape of cap 210. Once driver 230 is positioned against driver seat 220, front volume 223 may be acoustically isolated from a back volume (not shown). Driver seat 220 may include apertures 221 and 222 that align with directional sound port 211 and front leak 212, respectively. Apertures 221 and 222 can ensure that driver seat 220 does not obstruct sound waves as they travel from front volume 223 through sound port 211 and front leak 212. Driver seat 220 may also provide support to other components of cap sub-assembly 200. For example, snorkel mesh 281 and front leak mesh 282 are positioned between driver seat 220 and cap 210, and driver seat 220 may press meshes 281 and 282 against cap 210. Driver seat 220 can help hold meshes 281 and 282 in place and ensure that meshes 281 and 282 cannot be pushed into front volume 223.

Cap sub-assembly 200 may include snorkel mesh 281 and front leak mesh 282 to provide aesthetically pleasing external surfaces and protect internal components. Meshes 281 and 282 may be fixed to either cap 210 or driver seat 220 using any suitable method (e.g., using an adhesive). For example, snorkel mesh 281 is fixed to driver seat 220 while front leak mesh 282 is fixed to an inner surface of cap 210. Meshes 281 and 282 may prevent foreign objects and substances (e.g., debris, dust, and/or water) from entering cap sub-assembly 200 and damaging driver 230 or other components. Cap 210 may be designed such that meshes 281 and 282 are recessed from an external surface of cap 210. For example, as shown in FIG. 4A, snorkel mesh 281 and front leak mesh 282 are recessed relative to the perimeter of cap 210. Recessing meshes 281 and 282 reduces the amount of contact they have with external surfaces and as a result may reduce the buildup of foreign substances (e.g., earwax) on them.

Figure 5:
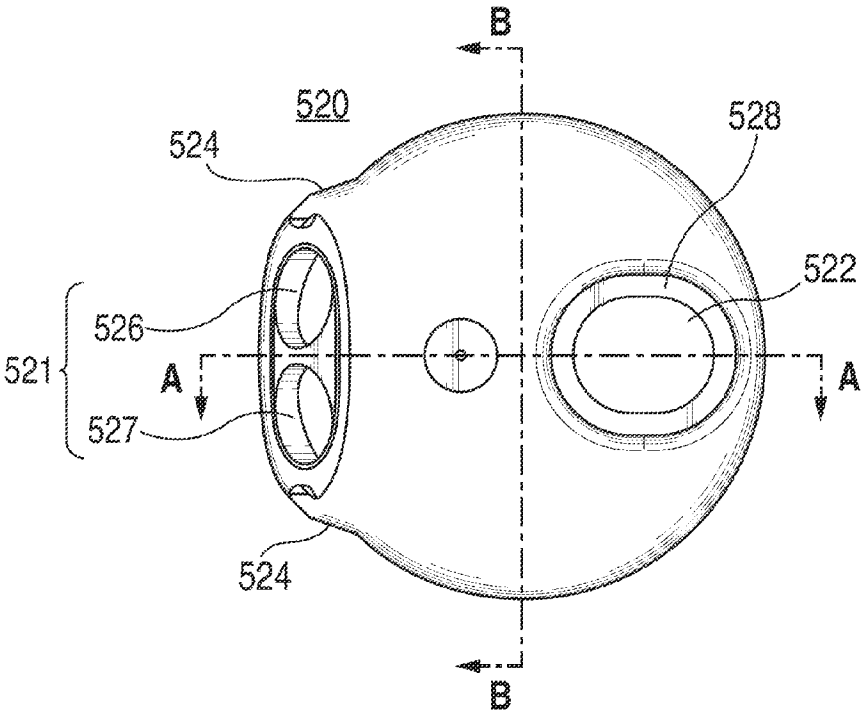
FIG. 5 shows a perspective top view of an illustrative mid-mold structure in accordance with an embodiment of the invention.
Figure 6B:
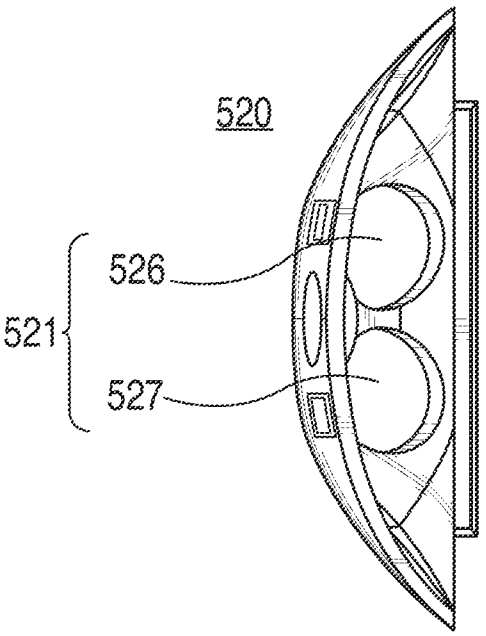
FIG. 6B shows a cross-sectional view of the mid-mold structure of FIG. 5, taken from line B-B of FIG. 5, in accordance with an embodiment of the invention.
Figure 6A:
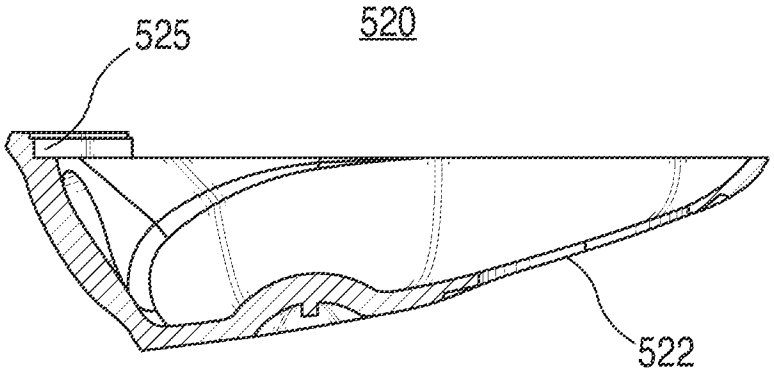
FIG. 6A shows a cross-sectional view of the mid-mold structure of FIG. 5, taken from line A-A of FIG. 5, in accordance with an embodiment of the invention.

Referring now to FIGS. 5-6B, various views of an illustrative mid-mold structure in accordance with some embodiments of the invention are shown. In particular, FIG. 5 shows a perspective top view of driver seat 520, FIG. 6A shows a cross-sectional view of driver seat 520, taken from line A-A of FIG. 5, and FIG. 6B shows a cross-sectional view of driver seat 520, taken from line B-B of FIG. 5. Driver seat 520 can be constructed from plastic and may be injection molded. As shown, driver seat 520 may include apertures 521 and 522 that align with corresponding apertures in an earbud housing (e.g., apertures 111 and 112 of FIG. 1). Aperture 521 may include multiple apertures (e.g., apertures 526 and 527) to provide adequate passage for sound waves generated by a driver while also enhancing structural integrity. For example, the material between apertures 526 and 527 may provide support for a mesh (e.g., snorkel mesh 181 of FIG. 1) and ensure that the mesh is not dented or forced inwards. Driver seat 520 may include recess 528 around the perimeter of aperture 522 in order to accommodate and help orient a mesh that is placed over aperture 522 (e.g., front leak mesh 182 of FIG. 1). Driver seat 520 may also include recess 525 for receiving a driver (e.g., driver 130 of FIG. 1). Driver seat 520 may include passive alignment features to help properly position it within a corresponding cap (e.g., cap 110 of FIG. 1). For example, driver seat 520 may include "flat" features 524 that align with a corresponding feature in the cap to determine the orientation of driver seat 520 within the cap. Flats 524 may datum against similar features in the cap.

Figure 7:
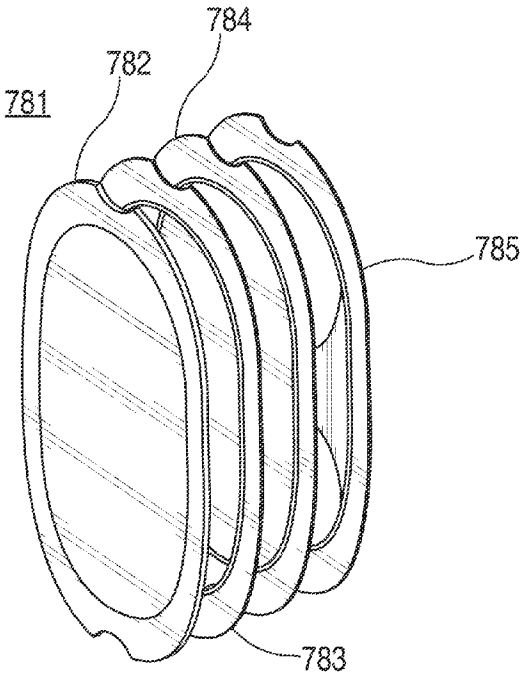
FIG. 7 shows an exploded view of a mesh assembly in accordance with an embodiment of the invention.

Referring now to FIG. 7, an exploded view of a mesh assembly in accordance with an embodiment of the invention is shown. Mesh assembly 781 may correspond to snorkel mesh 181 of FIG. 1 both in terms of shape and construction. Mesh assembly 781 may include cosmetic mesh 782, which forms a front surface of mesh assembly 781. Cosmetic mesh 782 may have a metallic coating on its front surface to provide an aesthetically pleasing finish. For example, cosmetic mesh 782 may undergo physical vapor deposition to apply a thin, highly-adhered pure metal or alloy coating to its front surface. As another example, mesh 782 can be a stainless steel mesh. Mesh assembly 781 may include acoustic mesh 784, which may provide debris protection and water repellency, and a desired impact on sound performance. For example, a specific acoustic resistance value may be chosen for acoustic mesh 784 to properly tune the damping associated with a port mesh assembly 781 is placed over. In this way, a desired overall frequency response may be achieved. Mesh assembly 781 may also include adhesive layer 783 to couple cosmetic mesh 782 to acoustic mesh 784. Mesh assembly 781 may further include adhesive layer 785 to couple mesh assembly 781 to another element of an earbud (e.g., driver seat 120 of FIG. 1).

Figure 8:
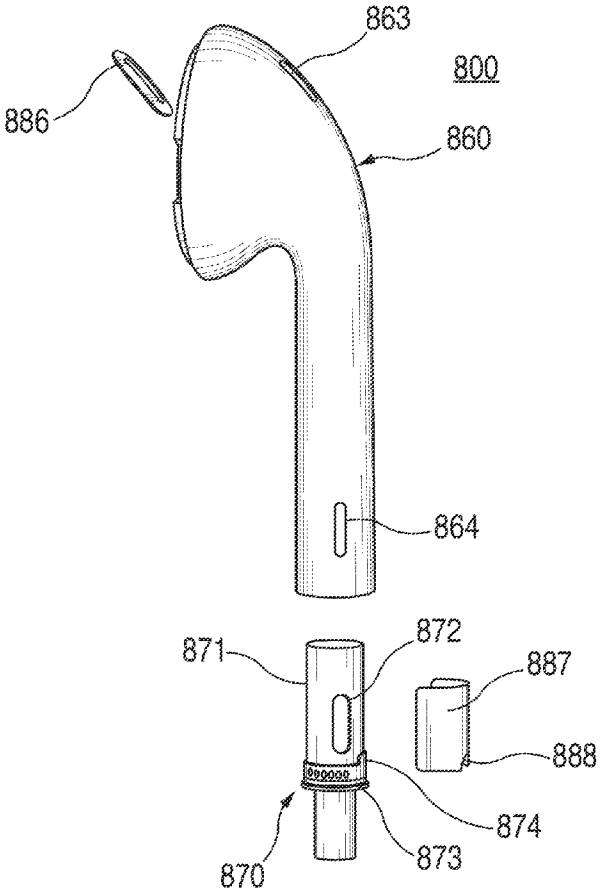
FIG. 8 shows an exploded view of an illustrative rear housing sub-assembly in accordance with an embodiment of the invention.
Figure 9B:
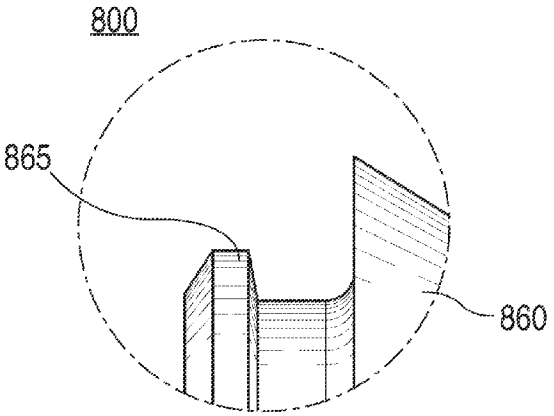
FIG. 9B shows a partial cross-sectional view of the rear housing sub-assembly of FIG. 9A, showing a magnified view of section B from FIG. 9A in accordance with an embodiment of the invention.
Figure 9A:
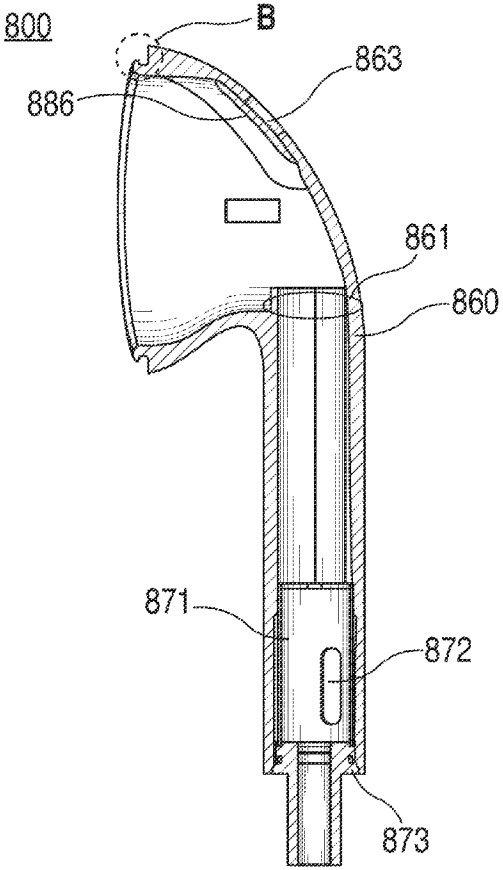
FIG. 9A shows a cross-sectional view of the rear housing sub-assembly of FIG. 8 in accordance with an embodiment of the invention.

FIGS. 8, 9A, and 9B show various views of illustrative rear housing sub-assembly 800 in accordance with some embodiments of the invention. In particular, FIG. 8 shows an exploded view of rear housing sub-assembly 800, FIG. 9A shows a cross-sectional view of rear housing sub-assembly 800, and FIG. 9B shows a partial cross-sectional view of rear housing sub-assembly 800, showing a magnified view of section B from FIG. 9A. Rear housing sub-assembly 800 may include rear housing 860, tail plug 870, back vent mesh 886, and bass port mesh 867. The elements of rear housing sub-assembly 800 may be substantially the same as similarly-numbered elements of earbud 100, and elements of FIGS. 8, 9A, and 9B may have some or all features as similarly-numbered elements of FIG. 1.

Rear housing sub-assembly 800 may include rear housing 860, which can serve as a housing for the remaining components of rear housing sub-assembly 800. Rear housing 860 may be formed in any suitable manner and may be made from any suitable material. For example, rear housing 860 may be molded from plastic. Rear housing 860 may include one or more bass ports 864, which provide a pathway for air to escape from rear housing 860. Only one bass port 864 is shown in FIG. 8. Bass port 864 may be shaped and positioned to enhance a particular frequency response of an earbud (e.g., bass frequencies). For example, the size of bass port(s) 864 can be dimensioned so that its cross-sectional area equals the cross-sectional area of housing 860 at region 861. This can ensure no back pressure exists between region 861 and bass port(s) 864. Rear housing 860 may also include back vent 863. The placement and size of back vent 863 may also be chosen based on acoustic considerations. For example, back vent 863 may be designed such that it provides proper venting for a driver (e.g., driver 130 of FIG. 1) and/or such that it tunes a particular frequency range. Rear housing 860 may include features that help it mate with a corresponding cap (e.g., cap 110 of FIG. 1) to form an external enclosure. As shown in FIG. 9B, rear housing 860 may include snap 865, which is operative to couple with a snap on a cap.

Rear housing sub-assembly 860 may also include tail plug 870. Tail plug 870 may have a two-part construction including skeleton 871 and sealing member 873. Tail plug 870 may be inserted into an opening in the bottom of rear housing 860 to acoustically seal rear housing 860. As shown in FIG. 9A, once tail plug 870 is inserted into rear housing 860, air may not be able to escape past the seal created between sealing member 873 and an interior surface of rear housing 860. Instead, air from inside rear housing 860 may be forced through bass port 864.

Skeleton 871 may include apertures 872 that align with bass port(s) 864 to provide an unobstructed pathway for air to escape from rear housing 860 via bass ports 864. The size of apertures 872 can be larger than the size of bass ports 864 to accommodate variations in assembly tolerances. This way, if alignment of skeleton 871 with respect to housing 860 is slightly off its intended alignment, a pathway for air still exists. Additionally, skeleton 871 may help hold bass port mesh 887 in place and ensure that it cannot be pushed into the interior volume of rear housing 860. Sealing member 873 may include a feature (e.g., protrusion 874) that aligns with a notch of bass port mesh 887 (e.g., notch 888) to ensure bass port mesh 887 is placed in a desired position.

Rear housing sub-assembly 800 may include back vent mesh 886 and bass port mesh 887 to cover back vent 863 and bass port 864, respectively. Meshes 886 and 887 may provide aesthetically pleasing external surfaces and prevent debris from entering rear housing 860. Additionally, meshes 886 and 887 may have any desired acoustic resistance values in order to achieve a desired frequency response. Back vent mesh 886 may be fixed to rear housing 860 using any suitable method. For example, back vent mesh may include an adhesive layer similar to that described with respect to mesh assembly 781 that allows back vent mesh 886 to attach to an inner surface of rear housing 860. Bass port mesh 887 may be fixed to skeleton 871 and/or rear housing 860 using any suitable method. For example, bass port mesh 887 may also include an adhesive layer that allows it to attach to an outer surface of skeleton 871.

Figure 11:
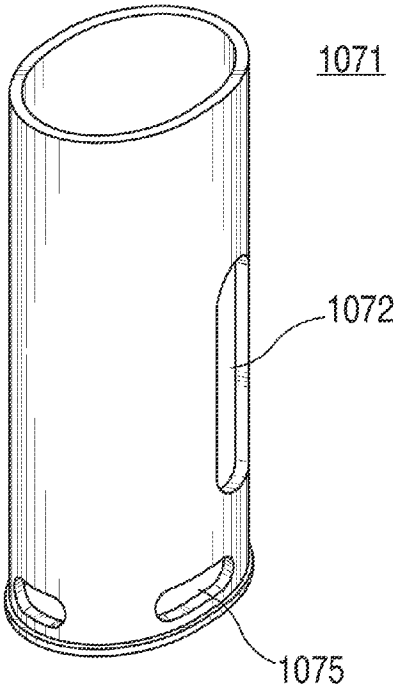
FIG. 11 shows a perspective view of a portion of the tail plug of FIG. 10 in accordance with an embodiment of the invention.
Figure 10:
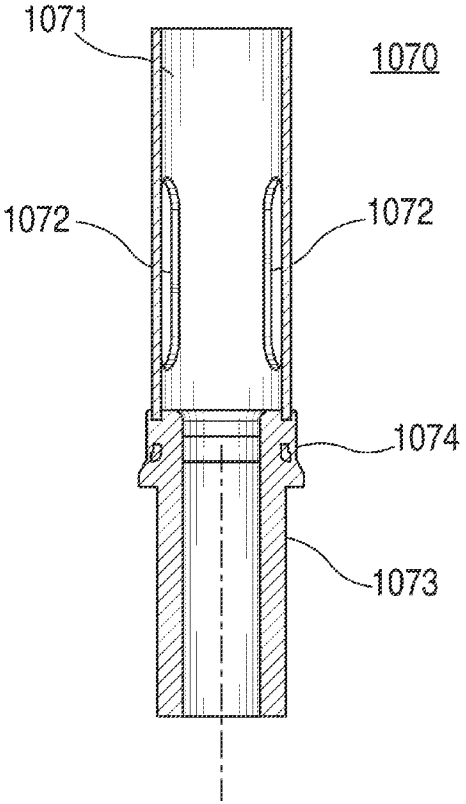
FIG. 10 shows a cross-sectional view of an illustrative tail plug in accordance with an embodiment of the invention.

Referring now to FIGS. 10 and 11, views of an illustrative tail plug in accordance with an embodiment of the invention are shown. In particular, FIG. 10 shows a cross-sectional view of tail plug 1070 and FIG. 11 shows a perspective view of a portion of tail plug 1070. Tail plug 1070 may include skeleton 1071 and sealing member 1073. The elements of tail plug 1070 may be substantially the same as similarly-numbered elements of earbud 100, and elements of FIGS. 10 and 11 may have some or all features as similarly-numbered elements of FIG. 1.

Tail plug 1070 may include a rigid member, such as skeleton 1071. Skeleton 1071 may be constructed from any suitable material using any suitable method. For example, skeleton 1071 may be formed by deep drawing metal (e.g., phosphor bronze). Deep drawing facilitates formation of skeleton 1071 with a desired shape and desired features. For example, by deep drawing skeleton 1071, large apertures 1072 can be achieved in skeleton 1071 for bass considerations. Deep drawing can also facilitate formation of apertures 1075, as shown in FIG. 11. As described below, apertures 1075 may receive corresponding features of sealing member 1073 to provide an interference fit between skeleton 1071 and sealing member 1073. Once formed, skeleton 1071 may be coated with another material (e.g., nickel and/or chromium) to enhance its corrosion resistance, surface hardness, and/or appearance. For example, skeleton 1071 may be coated with multiple layers of nickel for corrosion resistance, then a thin layer of chromium to promote adhesion of sealing member 1073. In one embodiment, it may be coated with three layers of nickel and one layer of chromium.

In some embodiments, skeleton 1071 may be formed from plastic using a double-shot molding process. In these embodiments, high flow plastics may be used to achieve a desired shot length and thin-walled section. In other embodiments, skeleton 1071 may be formed using an extrusion process followed by the formation of apertures 1072 and 1075 (e.g., the apertures may be laser cut, stamped, or machined). In other embodiments, skeleton 1071 may be formed using a roll forming process followed by seam welding and the formation of apertures 1072 and 1075. In other embodiments, skeleton 1071 may be die cast.

Tail plug 1070 may also include a compliant member, such as sealing member 1073. Sealing member 1073 may be constructed from any suitable material. For example, sealing member 1073 may be made from silicone due to its inert nature and ability to withstand attacks from foreign substances (e.g., oils). Sealing member 1073 may have features that help it seal a corresponding tail of a rear housing. For example, sealing member 1073 is formed with features 1074 that follow a contour of a corresponding rear housing (e.g., rear housing 160 of FIG. 1) and provide a desired interference fit between sealing member 1073 and the rear housing.

Skeleton 1071 and sealing member 1073 may be coupled in any suitable manner. For example, sealing member 1073 may be overmolded over a portion of skeleton 1071. Prior to overmolding sealing member 1073, a primer may be applied to skeleton 1071. The primer provides a chemical between skeleton 1071 and sealing member 1073. During the overmolding process, portions of sealing member 1073 may fill apertures 1075. Apertures 1075 may interact with sealing member 1073 to provide an interference fit and help retain sealing member 1073 to skeleton 1071. Thus, even if delamination occurs, the interaction between apertures 1075 and sealing member 1073 can hold skeleton 1071 and sealing member 1073 together.

During assembly, glue may be disposed within the interior of housing 860 and tailplug 870 is inserted into the opening at the bottom of housing 860. The glue can encapsulate skeleton 871 and bond it to the interior surface of housing 860.

Figure 13:
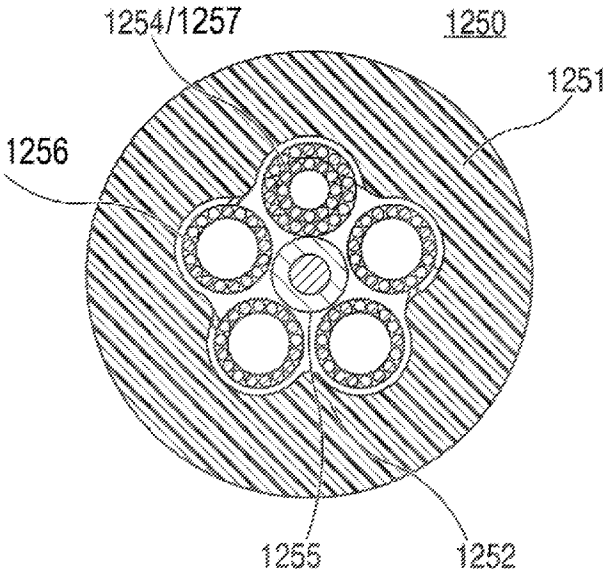
FIG. 13 shows a cross-sectional view of the cable of FIG. 12 in accordance with an embodiment of the invention.
Figure 12:
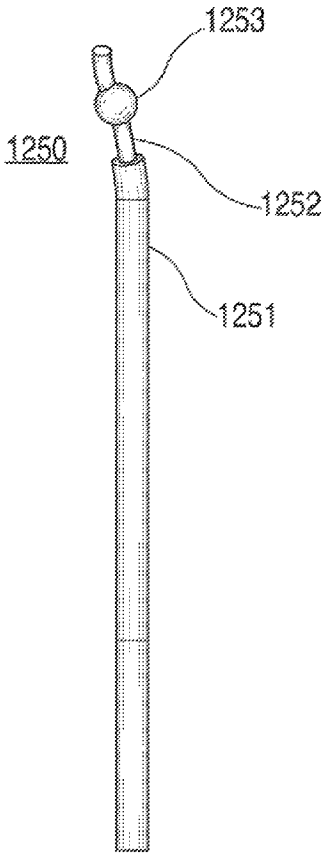
FIG. 12 shows a perspective view of an illustrative cable in accordance with an embodiment of the invention.

FIGS. 12 and 13 show various views of an illustrative cable for use in a cable sub-assembly in accordance with some embodiments of the invention. In particular, FIG. 12 shows a perspective view of cable 1250 and FIG. 13 shows a cross-sectional view of cable 1250. Cable 1250 may include cable jacket 1251, bundle 1252, and knot 1253. Cable 1250 may correspond to cable 150 of FIG. 1 and may have some or all features as similarly-numbered elements of FIG. 1.

Cable 1250 may include a bundle of conductor wires, such as bundle 1252. Bundle 1252 may include several tensile members 1255 that run through bundle 1252 and improve the tensile strength of cable 1250. Tensile members 1255 may be constructed from any suitable material, including, but not limited to, Zylon, Kevlar, Nomex, or Technora. Conductor wires 1254 may be wrapped around some of tensile members 1255 in order to create mini-bundles (e.g., mini-bundles 1256 and 1257). Mini-bundles may include a single layer of conductor wires (e.g., mini-bundle 1256) or a double layer of conductor wires (e.g., mini-bundle 1257). The mini-bundles and tensile members of bundle 1252 may have any suitable arrangement. For example, they may have the "flower" shape shown in FIG. 13.

Cable 1250 may include cable jacket 1251 to protect other components (e.g., bundle 1252) of cable 1250. Cable jacket 1251 may be constructed from any suitable material and may be formed in any suitable manner. For example, cable jacket 1251 may be extruded from plastic. Cable jacket 1251 may have any suitable inner cross-section for accommodating bundle 1252 (e.g., circular or flower shaped).

Cable 1250 may also include knot 1253. Knot 1253 may be formed by tying the mini-bundles of bundle 1252 into a figure-eight. Knot 1253 may be located a predetermined distance from cable jacket 1251 and may help determine the location of a rear-mold structure (not shown) as described below with respect to FIGS. 14A-15.

Figure 14B:
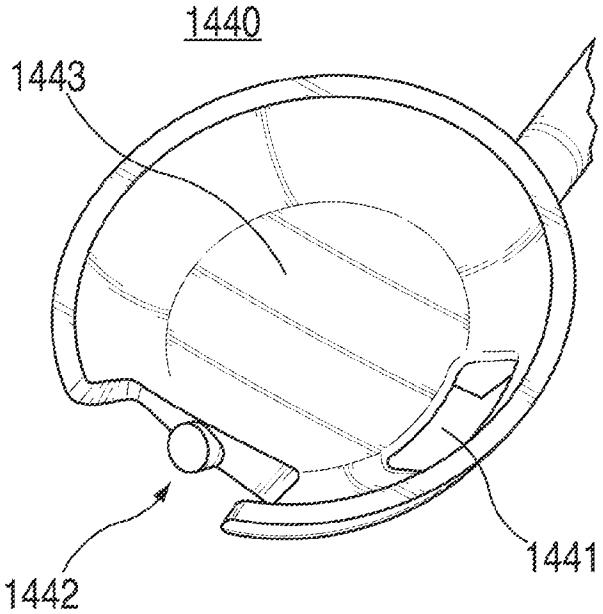
FIG. 14B shows a perspective front view of the rear-mold structure of FIG. 14A in accordance with an embodiment of the invention.
Figure 14A:
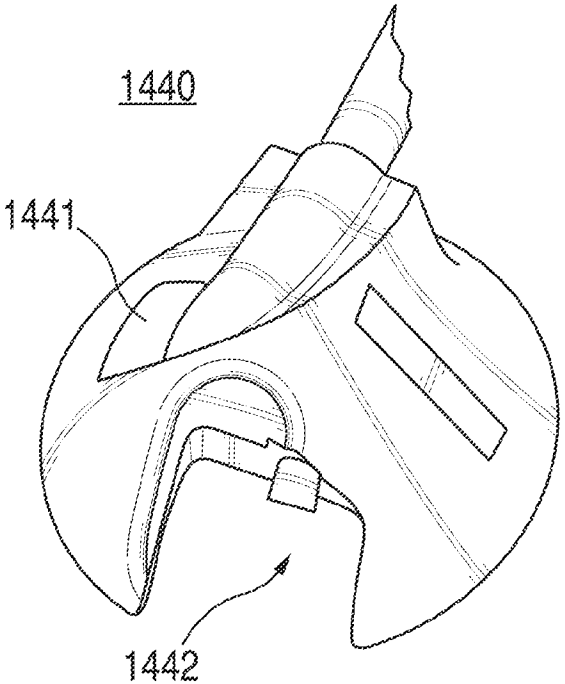
FIG. 14A shows a perspective rear view of an illustrative rear-mold structure in accordance with an embodiment of the invention.
Figure 15:
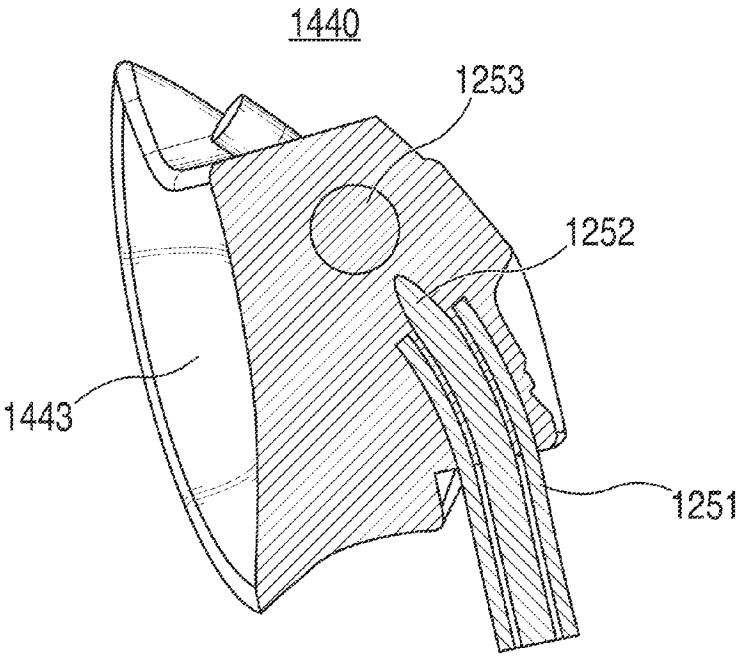
FIG. 15 shows a cross-sectional view of the rear-mold structure of FIG. 14A in accordance with an embodiment of the invention.

Referring now to FIGS. 14A, 14B, and 15, views of an illustrative rear-mold structure are shown in accordance with some embodiments of the invention. In particular, FIG. 14A shows a perspective rear view of terminator 1440, FIG. 14B shows a perspective front view of terminator 1440, and FIG. 15 shows a cross-sectional view of terminator 1440. The elements of terminator 1440 may be substantially the same as similarly-numbered elements of earbud 100, and elements of FIGS. 14A-15 may have some or all features as similarly-numbered elements of FIG. 1. For purposes of illustration and not of limitation, terminator 1440 is shown overmolded over cable 1250 of FIGS. 12 and 13.

Terminator 1440 may be constructed from any suitable material and may be formed in any suitable manner. For example, terminator 1440 may be molded from plastic. Terminator 1440 may be overmolded over the end of a cable (e.g., cable 1250 of FIG. 12) and may envelop a portion of the cable. For example, as shown in FIG. 15, terminator 1440 may envelop knot 1253 as well as portions of bundle 1252 and cable jacket 1251. Overmolding terminator 1440 over a cable may serve to "terminate" the cable. As a result, terminator 1440 may secure the cable within a housing of an earbud (e.g., rear housing 160 of earbud 100) and prevent the cable from being separated from the housing. During the overmolding process, an end of the cable (e.g., an end including a knot) may be positioned in a predetermined location within a mold in order to ensure that terminator 1440 is formed in a desired location and with a desired orientation. In some embodiments, prior to molding terminator 1440, a plastic insert (not shown) can be loaded in the mold to help hold the cable in a desired location and to improve the integrity of terminator 1440.

In addition to terminating a cable, terminator 1440 may also define a desired rear volume for a driver of an earbud (e.g., driver 130 of earbud 100). Terminator 1440 may include cavity 1443 that can provide a rear volume of a predetermined size and shape, regardless of the shape of a housing that terminator 1440 is located in. Cavity 1443 may have any suitable shape and finish. For example, cavity 1443 may have a hemispherical shape with a smooth finish as shown in FIG. 14B. Terminator 1440 may also include port 1441 and cutout 1442. Port 1441 may allow air from behind a driver to flow along a desired path. Along with cavity 1443, cutout 1442 may further define a desired shape for the rear volume. In addition, cutout 1442 can provide access to a bundle of a cable (e.g., bundle 1252 of cable 1250) so that the bundle may be coupled to the driver. As a result of its size and shape, terminator 1440 can aid with the acoustical tuning of an earbud (e.g., earbud 100 of FIG. 1). For example, port 1441 may tune mid-band frequency response of the earbud.

Figure 16:
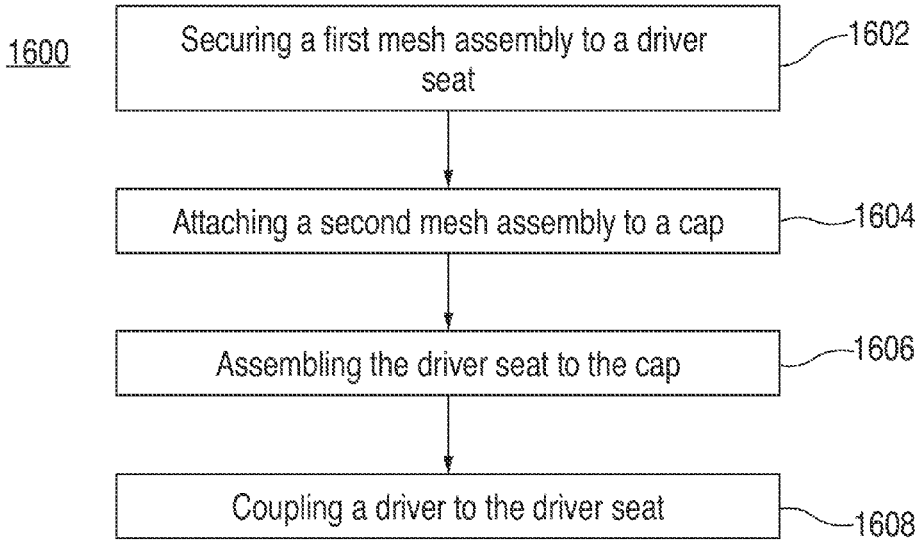
FIG. 16 shows an illustrative method for constructing a cap sub-assembly in accordance with some embodiments of the invention.

Turning now to FIG. 16, an illustrative method for constructing a cap sub-assembly in accordance with some embodiments of the invention is shown. Method 1600 may begin at step 1602. At step 1602, a first mesh assembly (e.g., snorkel mesh 181 of FIG. 1) may be secured to a driver seat (e.g., driver seat 120 of FIG. 1) using any suitable method. For example, the first mesh assembly may be fixed to the driver seat using a pressure sensitive adhesive. The first mesh assembly may be similar to mesh assembly 781 of FIG. 7 and may share some or all features of mesh assembly 781. For example, the first mesh assembly may include an adhesive layer that facilitates attaching it to the driver seat.

At step 1604, a second mesh assembly (e.g., front leak mesh 182 of FIG. 1) may be attached to a cap (e.g., cap 110 of FIG. 1) using any suitable method. For example, the second mesh assembly may be fixed to the cap using an adhesive. Similar to the first mesh assembly, the second mesh may also include an adhesive layer that facilitates attaching it to the cap.

At step 1606, the driver seat may be assembled to the cap using any suitable method. For example, glue may be applied to an inner surface of the cap and/or to an outer surface of the driver seat, and the driver seat may by inserted into the cap. In embodiments that use glue, the driver seat may need to be held in place until the glue cures. The shape of the driver seat along with passive alignment features (e.g., as described with respect to FIG. 5) may ensure that the driver seat is positioned within the cap in a desired orientation.

At step 1608, a driver (e.g., driver 130 of FIG. 1) may be coupled to the driver seat using any suitable method. For example, the cap containing the driver seat may be located in a cap nest (e.g., as described below with respect to FIGS. 20-23), and the cap nest may contain a magnet. The magnet in the cap nest may hold the driver against the driver seat and the cap (e.g., the magnet in the cap nest may attract a magnet in the driver). Thus, the resulting cap sub-assembly may be held in place by the magnet in the cap nest until the cap sub-assembly can be assembled with a cable sub-assembly and a rear housing sub-assembly to form an earbud (e.g., as described below with respect to FIG. 23). Using a magnet may allow the cap sub-assembly to be held in place without using any adhesives that could potentially damage a sensitive diaphragm system of the driver.

Illustrative method 1600 has been described for purposes of illustration. A person skilled in the art will appreciate that one or more steps of method 1600 can be altered or rearranged without deviating from the scope of method 1600. For example, step 1604 may be performed before step 1602. As another example, the first mesh assembly could be assembled to the cap in step 1602 and/or the second mesh assembly could be assembled to the driver seat in step 1604.

Figure 17:
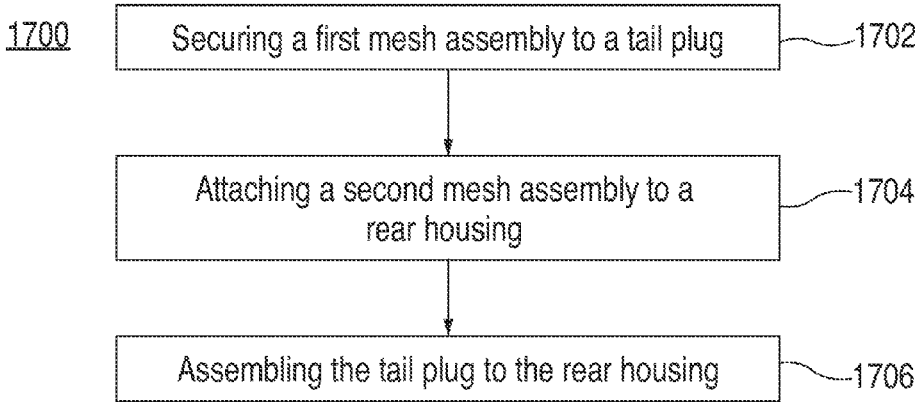
FIG. 17 shows an illustrative method for constructing a rear housing sub-assembly in accordance with some embodiments of the invention.

Referring now to FIG. 17, an illustrative method for constructing a rear housing sub-assembly in accordance with some embodiments of the invention is shown. Method 1700 may begin at step 1702. At step 1702, a first mesh assembly (e.g., bass port mesh 187 of FIG. 1) may be secured to a tail plug (e.g., tail plug 170 of FIG. 1) using any suitable method. For example, the first mesh assembly may be fixed to the tail plug using a pressure sensitive adhesive. The first mesh assembly may be similar to mesh assembly 781 of FIG. 7 and may share some or all features of mesh assembly 781. For example, the first mesh assembly may include an adhesive layer that facilitates attaching it to the tail plug. As described with respect to FIG. 8, the tail plug may include a feature that aligns the first mesh assembly in a desired position.

At step 1704, a second mesh assembly (e.g., back vent mesh 186 of FIG. 1) may be attached to a rear housing (e.g., rear housing 160 of FIG. 1) using any suitable method. For example, the second mesh assembly may be fixed to an inner surface of the rear housing an adhesive. Similar to the first mesh assembly, the second mesh may also include an adhesive layer that facilitates attaching it to the rear housing.

At step 1706, the tail plug may be assembled to the rear housing any suitable method. For example, glue may be applied to an inner surface of the rear housing and/or to an outer surface of the tail plug, and the tail plug may by inserted into the rear housing. A person skilled in the art will appreciate that one or more steps of method 1700 can be rearranged without deviating from the scope of method 1700. For example, step 1704 may be performed before step 1702.

Figure 18:
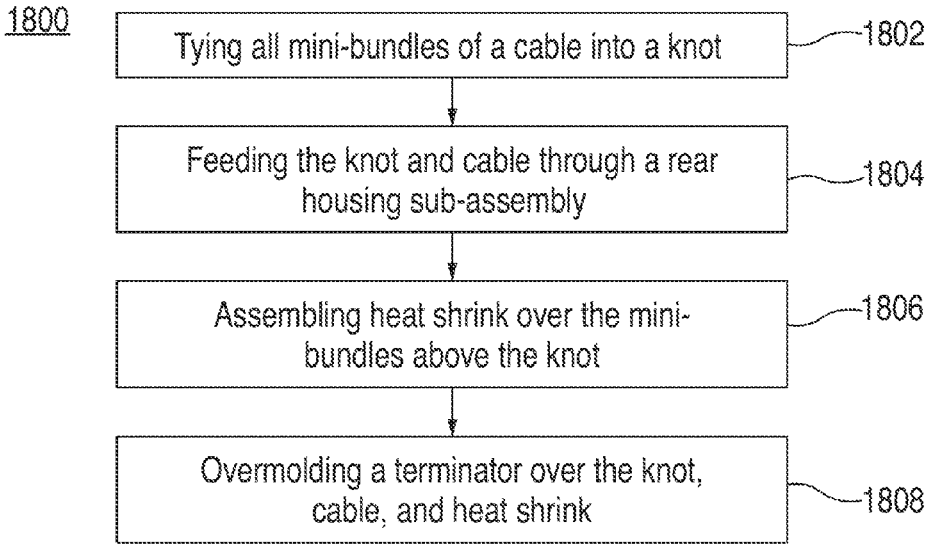
FIG. 18 shows an illustrative method for constructing a cable sub-assembly in accordance with some embodiments of the invention.

FIG. 18 shows an illustrative method for constructing a cable sub-assembly in accordance with some embodiments of the invention. Method 1800 may begin at step 1802. At step 1802, all mini-bundles of a cable (e.g., cable 150 of FIG. 1) may be tied into a knot (e.g., a figure-eight knot). The knot may be tied at a predetermined distance from a cable jacket of the cable.

At step 1804, the knot and cable may be fed through a rear housing sub-assembly (e.g., rear housing sub-assembly 800 of FIG. 8). For example, the knot may be inserted through a tail plug hole of the rear housing sub-assembly and fed through the sub-assembly until the knot emerges from a second opening in the sub-assembly. To make feeding the knot and cable through the rear housing sub-assembly easier, a small amount of lubricant may be applied to a portion of the cable (e.g., to an exterior surface of the cable jacket). The knot and cable may be fed through the rear housing sub-assembly until a predetermined amount of the cable passes through the rear housing sub-assembly.

At step 1806, heat shrink may be assembled over the mini-bundles of the cable above the knot. The heat shrink may provide electrical insulation, protection from dust, solvents and other foreign materials, as well as strain relief.

At step 1808, a terminator (e.g., terminator 140 of FIG. 1) may be overmolded over the knot, cable, and heat shrink using any suitable method. For example, the terminator may be injection molded using plastic. The terminator may determine cable matching (e.g., left and right cable matching of two separate earbuds), and as a result the terminator may be overmolded in a precise location/orientation.

Figure 19:
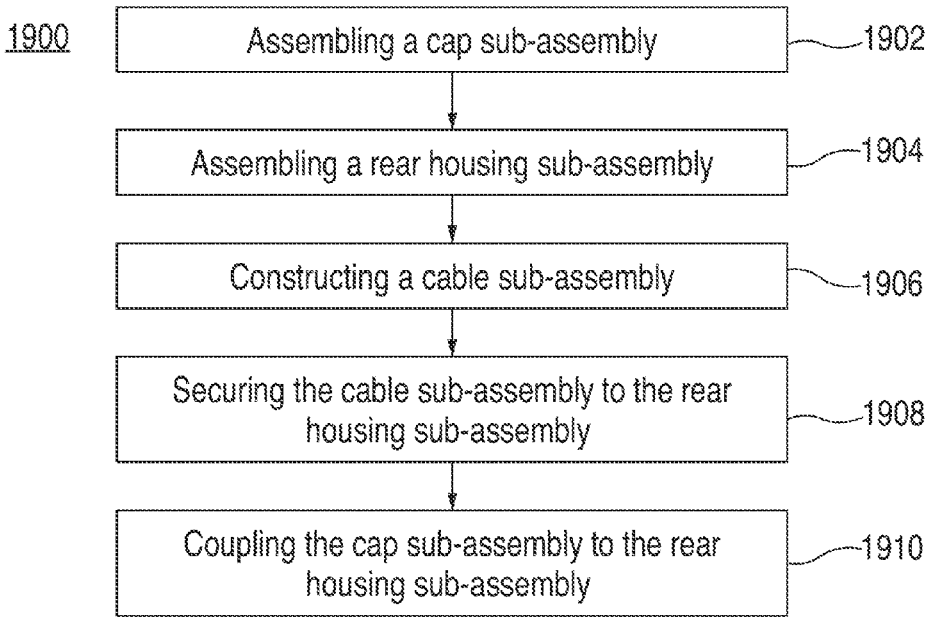
FIG. 19 shows an illustrative general assembly method for constructing an earbud in accordance with some embodiments of the invention.

Referring now to FIG. 19, an illustrative general assembly method for constructing an earbud in accordance with some embodiments of the invention is shown. Method 1900 may begin at step 1902. At step 1902, a cap sub-assembly (e.g., cap sub-assembly 200 of FIG. 2) may be assembled using any suitable method. For example, the cap sub-assembly can be constructed using method 1600 as described with respect to FIG. 16.

At step 1904, a rear housing sub-assembly (e.g., rear housing sub-assembly 800 of FIG. 8) may be assembled using any suitable method. For example, the rear housing sub-assembly can be constructed using method 1700 as described with respect to FIG. 17.

At step 1906, a cable sub-assembly may be constructed using any suitable method. For example, the cable sub-assembly can be constructed using method 1800 as described with respect to FIG. 18.

At step 1908, the cable sub-assembly may be secured to the rear housing sub-assembly using any suitable method. For example, assembling the cable sub-assembly to the rear housing sub-assembly may include applying glue to an inner surface of the rear housing sub-assembly and/or an outer surface of the cable sub-assembly and attaching the cable sub-assembly to the rear housing sub-assembly.

At step 1910, the cap sub-assembly may be coupled to the rear housing sub-assembly using any suitable method. For example, coupling the cap sub-assembly to the rear housing sub-assembly can be accomplished by following a zero gap/offset methodology as described below with reference to FIG. 23.

Figure 20:
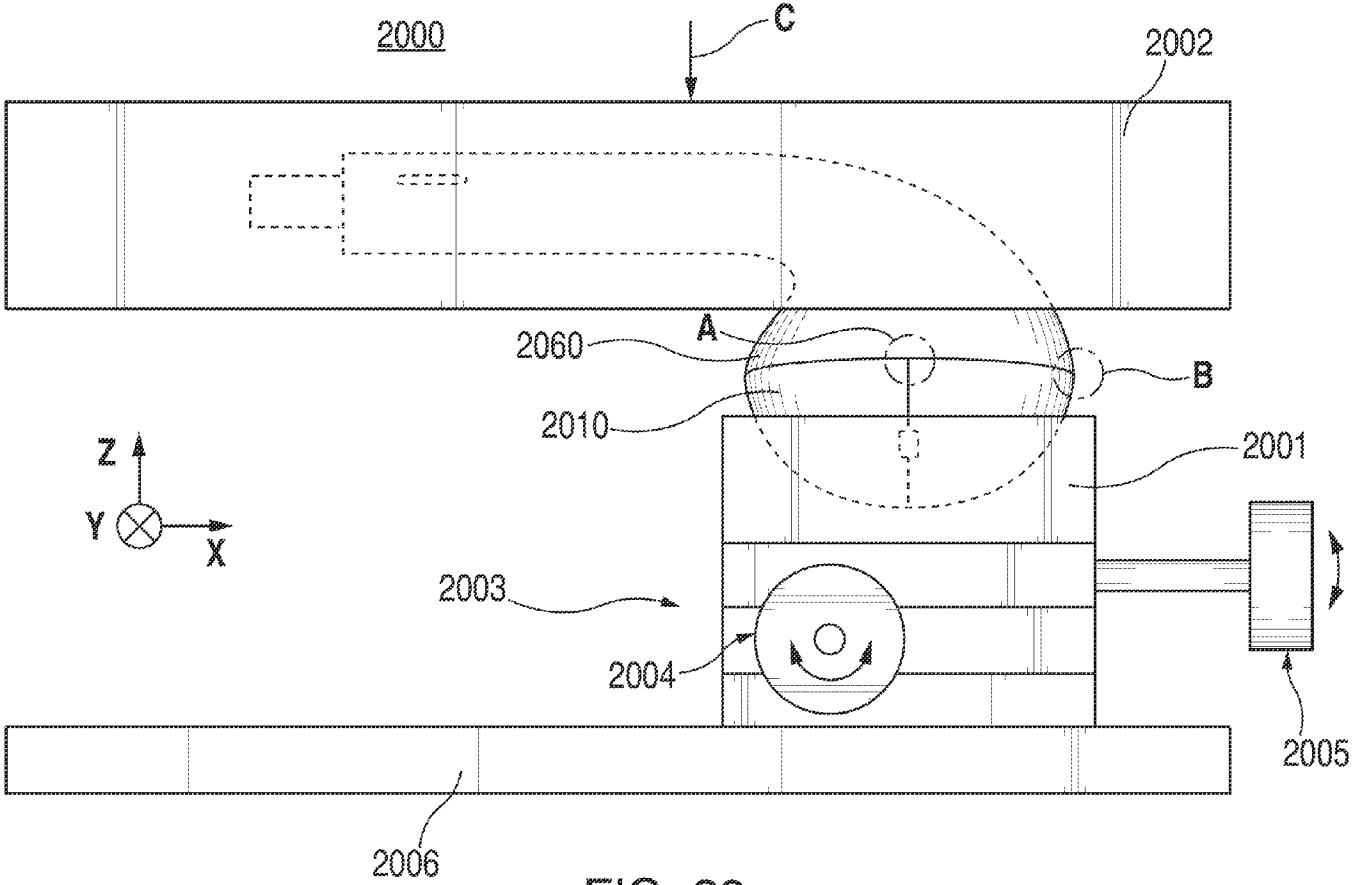
FIG. 20 shows an illustrative alignment apparatus containing an earbud in accordance with some embodiment of the invention.
Figure 21:
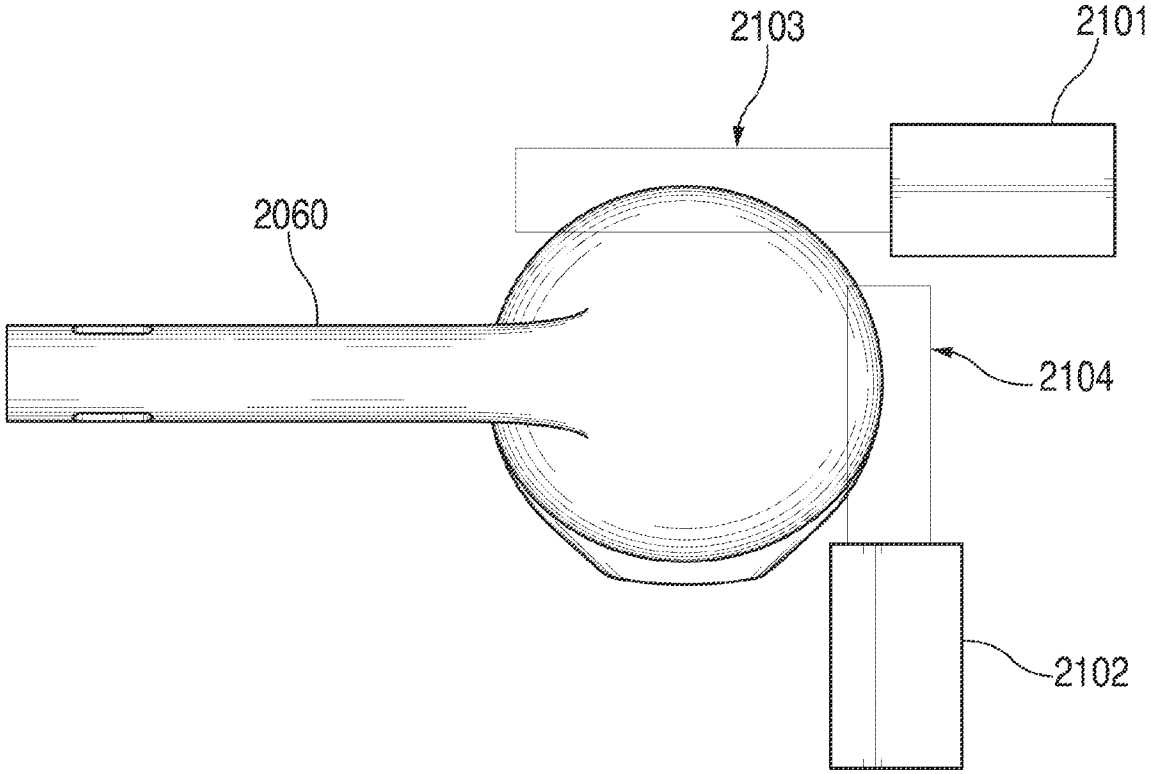
FIG. 21 shows a perspective top view of the earbud of FIG. 20 along with two illustrative alignment verification devices in accordance with some embodiment of the invention.
Figure 22:
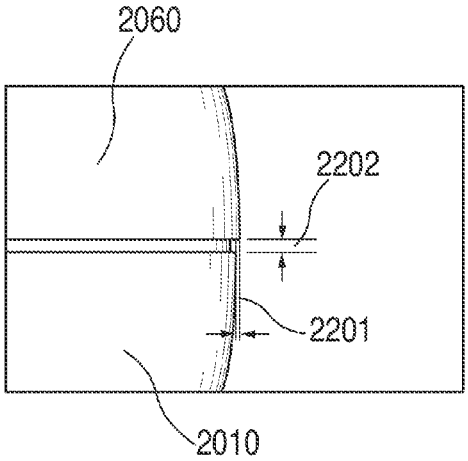
FIG. 22 shows a perspective side view of the earbud of FIG. 20 from a vantage point of one of the alignment verification devices of FIG. 21 in accordance with some embodiments of the invention.

To achieve final assembly of an earbud with a desired alignment (e.g., minimum gap and offset as described below with respect to FIG. 23) specially designed equipment may be required. FIGS. 20-22 show views of equipment that may be used in combination with method 2300 of FIG. 23 such that zero gap and offset between a cap and a rear housing of an earbud can be achieved. In particular, FIG. 20 shows an illustrative alignment apparatus containing an earbud in accordance with some embodiments of the invention, FIG. 21 shows a perspective top view of the earbud of FIG. 20 along with two illustrative alignment verification devices in accordance with some embodiments of the invention, and FIG. 22 shows a perspective side view of the earbud of FIG. 20 from a vantage point of one of the alignment verification devices of FIG. 21 in accordance with some embodiments of the invention.

As shown in FIG. 20, alignment device 2000 may include fixture nests (e.g., cap nest 2001 and rear housing nest 2002) for holding an earbud. Cap nest 2001 may hold cap 2010 of the earbud while rear housing nest 2002 may hold rear housing 2060 of the earbud. Nests 2001 and 2002 may be constructed from any suitable material. For example, nests 2001 and 2002 may be made from a non-marking plastic that will not damage or mark-up outer surfaces of cap 2010 or rear housing 2060. In addition, nests 2001 and 2002 may include elements that help secure cap 2010 or rear housing 2060, respectively. For example, cap nest 2001 may include a magnet (not shown) that interacts with a magnet of a driver (not shown). The magnet within cap nest 2001 may attract the driver and effectively "sandwich" cap 2010 between cap nest 2001 and the driver.

Alignment device 2000 may also include an x-y stage (e.g., x-y stage 2003) for aligning cap 2010 and rear housing 2060. For example, rear housing nest 2002 may be held stationary while cap nest 2001 may move relative to rear housing nest 2002. Alignment control 2004 may determine x-axis positioning of cap nest 2001 (e.g., by turning alignment control 2004 clockwise or counterclockwise) while alignment control 2005 may determine y-axis positioning of cap nest 2001 (e.g., by turning alignment control 2005 clockwise or counterclockwise). A user may adjust alignment controls 2004 and 2005 until a desired alignment between cap 2010 and rear housing 2060 is achieved. In some embodiments, alignment device 2000 may include an alignment control (not shown) that allows an operator to adjust "clocking" (i.e., rotation of cap 2010 relative to rear housing 2060).

Alignment device 2000 may exert a mating force on cap 2010 and rear housing 2060 to help force them together during an alignment process (e.g., method 2300). For example, alignment device 2000 may include springs (not shown) that attach to rear housing nest 2002 and baseplate 2006. The springs may pull on rear housing nest 2002 such that they exert a force in the direction of arrow C on rear housing 2060. The force may be any suitable magnitude, including, for example, 30 Newtons. The force may ensure that cap 2010 and rear housing 2060 remain mated during the alignment process. In some embodiments, alignment device 2000 may include a pressing plate (not shown) that is used to apply force to either cap nest 2001 or rear housing nest 2002.

Turning now to FIG. 21, alignment verification devices (e.g., alignment verification devices 2101 and 2102) may be used in conjunction with alignment device 2000 to assess the alignment of an earbud. For clarity, FIG. 21 is shown without alignment device 2000. Alignment verification devices 2101 and 2102 may be any suitable devices that provide adequate observation of the earbud. For example, alignment verification devices 2101 and 2102 may be charge-coupled devices (CCD) that provide digital imaging of the earbud. As another example, alignment verification devices 2101 and 2102 may be laser measurement instruments. Alignment verification device 2101 may have field of view (FOV) 2103 that observes a first point of the earbud (e.g., point A of FIG. 20) while alignment verification device 2102 may have FOV 2104 that observes a second point of the earbud (e.g., point B of FIG. 20). The first and second points may have any suitable relationship to each other. For example, the first and second points may be offset from each other by 90 degrees. Referring briefly to FIG. 22, the view from alignment verification device 2101 is shown. Dimension 2201 may represent the offset between cap 2010 and rear housing 2060 while dimension 2202 may represent the gap between cap 2010 and rear housing 2060. A user may use information provided by alignment verification devices 2101 and 2102 (e.g., gap and offset information) to adjust alignment device 2000 and achieve a desired alignment of cap 2010 and rear housing 2060. In some embodiments, an additional alignment verification device (not shown) may be included to view the clocking angle of cap 2010 and rear housing 2060. In these embodiments, the alignment verification device may observe a parting line on each of cap 2010 and rear housing 2060.

Figure 23:
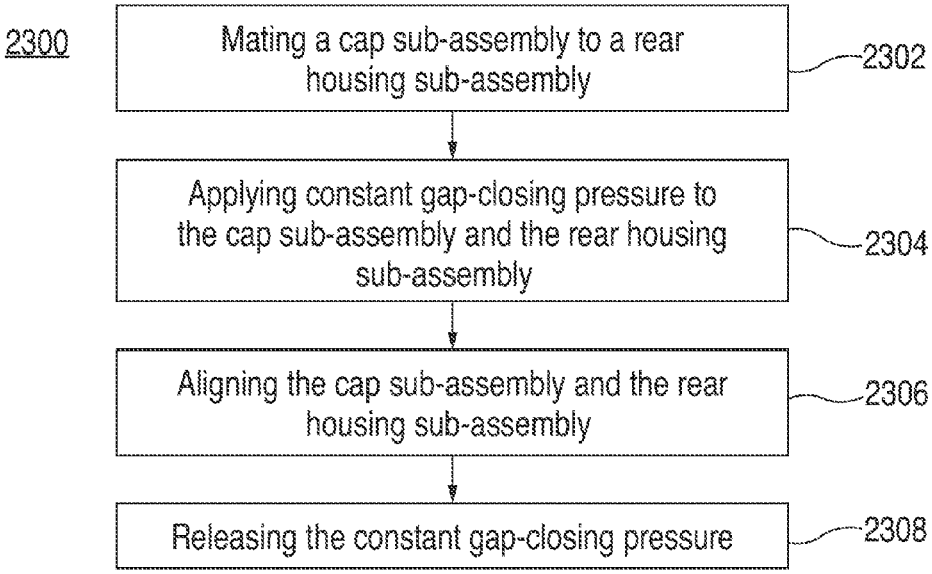
FIG. 23 shows an illustrative method for achieving minimum gap and offset when constructing an earbud in accordance with some embodiments of the invention.

Referring now to FIG. 23, an illustrative method for achieving minimum gap and offset when constructing an earbud in accordance with some embodiments of the invention is shown. Method 2300 may begin at step 2302. At step 2302, a cap sub-assembly (e.g., cap sub-assembly 200 of FIG. 2) may be mated to a rear housing sub-assembly (e.g., rear housing sub-assembly 800 of FIG. 8). The mating process may include applying glue to a back surface of a driver (e.g., driver 130 of FIG. 1) and/or a cap (e.g., cap 110 of FIG. 1) of the cap sub-assembly. The glue may be any suitable type of glue. For example, the glue may be a hot-melt glue that remains pliable until it cools. The glue may be applied around the entire periphery of the driver and/or cap such that it seals an acoustic chamber that exists between the driver and cap. The mating process may also include soldering mini-bundles of a cable (e.g., cable 150 of FIG. 1) to the driver. The mating process may further include snapping the cap to a rear housing of the rear housing sub-assembly.

At step 2304, constant gap-closing pressure may be applied to the cap and rear housing sub-assemblies. Gap-closing pressure may be applied using any suitable method or apparatus. For example, gap-closing pressure may be applied using an alignment device similar to alignment device 2000 of FIG. 20. Before step 2302, the cap and rear housing sub-assemblies may be loaded into fixture nests (e.g., cap nest 2001 and rear housing nest 2002 of FIG. 20) and the alignment device may apply the gap-closing pressure. The constant gap-closing pressure may be any suitable magnitude. For example, the gap-closing pressure may be 30 Newtons.

At step 2306, the cap and rear housing sub-assemblies may be aligned. The alignment process may be completed using any suitable method or apparatus. For example, the alignment process may be achieved using an alignment device similar to alignment device 2000 of FIG. 20. A user may adjust the positioning of the cap and rear housing sub-assemblies relative to each other using the alignment device. The alignment device may include an x-y stage that facilitates movement of either the cap sub-assembly or the rear housing sub-assembly while the other remains stationary. Using the alignment device, the user may adjust the position of the cap sub-assembly or the rear housing sub-assembly until the gap and offset between the sub-assemblies are minimized. In order to verify that both the gap and offset have been minimized, the user may utilize alignment verification devices similar to alignment verification devices 2101 and 2102 of FIG. 21. The alignment verification devices may be positioned to look at two tangent points of the cap and rear housing sub-assemblies. The tangent points may have any suitable relationship to one another. For example, the tangent points may be offset by 90 degrees. Once the user determines that the gap and offset between the cap and rear housing sub-assemblies have been minimized, the alignment process may conclude. In some embodiments, the alignment process may include rotating the cap and rear housing sub-assemblies until a desired clocking is achieved. In these embodiments, an additional alignment verification device may be used to observe a parting line on each of the cap and rear housing sub-assemblies.

At step 2308, the alignment process may be complete and the constant gap-closing pressure may be released. In embodiments that use a hot-melt glue, the gap-closing pressure may need to be applied until the hot-melt glue cools to room temperature. In these embodiments, release of the gap-closing pressure may be based on a predetermined length of time.

The previously described embodiments are presented for purposes of illustration and not of limitation. It is understood that one or more features of an embodiment can be combined with one or more features of another embodiment to provide apparatus and/or methods without deviating from the spirit and scope of the invention. It will also be understood that various directional and orientational terms are used herein only for convenience, and that no fixed or absolute directional or orientational limitations are intended by the use of these words. For example, the devices of this invention can have any desired orientation. If reoriented, different directional or orientational terms may need to be used in their description, but that will not alter their fundamental nature as within the scope and spirit of this invention. Those skilled in the art will appreciate that the invention can be practiced by other than the described embodiments, which are presented for purposes of illustration rather than of limitation, and the invention is limited only by the claims which follow.

What is claimed is:

1. An earbud comprising:

a cap;

a mid-mold secured to an inner surface of the cap;

a driver mounted to the mid-mold, wherein the mid-mold is positioned between the driver and the cap, wherein the mid-mold forms at least a portion of a front volume for the driver, wherein the cap comprises a primary sound port, wherein the mid-mold comprises an aperture aligned with the primary sound port, wherein the driver is operative to direct sound from the driver into the front volume, and wherein the front volume is operative to direct the sound from the front volume through the aperture and through the primary sound port;

a rear housing mated with the cap to form an external enclosure about the mid-mold, wherein the rear housing and cap provide a clearance fit with the driver to hold the driver in place; and a rear-mold secured to an inner surface of the rear housing.

2. The earbud of claim 1, further comprising a mesh assembly coupled to the mid-mold, wherein the mesh assembly covers the primary sound port.

3. The earbud of claim 1, wherein the cap further comprises a secondary aperture.

4. The earbud of claim 3, wherein the mid-mold comprises a second aperture aligned with the secondary aperture.

5. The earbud of claim 3, further comprising a mesh assembly coupled to an inner surface of the cap, wherein the mesh assembly covers the secondary aperture.

6. The earbud of claim 2, wherein the mesh assembly is recessed from an external surface of the cap.

7. The earbud of claim 1, wherein the mid-mold comprises an alignment feature, the alignment feature operative to align the mid-mold with the cap.

8. The earbud of claim 1, wherein the mid-mold comprises at least one recess operative to receive a mesh assembly.

9. The earbud of claim 2, wherein the mesh assembly comprises a cosmetic mesh layer and an acoustic mesh layer.

10. The earbud of claim 1, wherein the rear housing comprises at least one aperture.

11. The earbud of claim 10, further comprising a mesh assembly operative to cover the at least one aperture.

12. The earbud of claim 1, further comprising a tail plug, the tail plug operative to acoustically seal a tail portion of the rear housing.

13. The earbud of claim 1, further comprising a cable, wherein the rear-mold is overmolded over an end of the cable.

14. The earbud of claim 1, wherein the rear-mold comprises a port operative to allow air from behind the driver to escape.

15. The earbud of claim 13, wherein the rear-mold further comprises a cutout, wherein the cutout provides access to a bundle of the cable.

16. A tail plug for acoustically sealing a tail portion of an earbud and providing strain relief for a cable of the earbud, the tail plug comprising:

a hollow skeleton member shaped to fit within the tail portion and constructed from a rigid material, the skeleton member comprising a top portion, a bottom portion, and a side wall extending between the top portion and the bottom portion, the side wall comprising at least one aperture, wherein the at least one aperture is operative to at least partially align with a port in the tail portion when the skeleton member is fit within the tail portion, the skeleton member operative to pass the cable through the top portion and through the bottom portion; and a sealing member constructed from a compliant material, the sealing member coupled to the bottom portion of the skeleton member and operative to form an acoustic seal with the tail portion for forcing air within the tail portion through the port and the at least one aperture.

17. The tail plug of claim 16, further comprising a mesh that covers the at least one aperture and the port in the tail portion.

18. The tail plug of claim 16, wherein the skeleton member is deep drawn from metal.

19. The tail plug of claim 16, wherein the skeleton member further comprises at least two additional apertures, and wherein the sealing member is coupled to the skeleton member via an interference fit with the at least two additional apertures.

20. The tail plug of claim 16, wherein the skeleton member and sealing member are coupled via a chemical bond.

21. The tail plug of claim 16, wherein the sealing member comprises a shaped feature operative to follow a contour of the tail portion and provide an interference fit with the tail portion.

22. The tail plug of claim 16, wherein the sealing member is overmolded over the bottom portion of the skeleton member.

23. A terminator operative to serve as the termination point for an earbud cable of an earbud comprising a driver, wherein the earbud cable extends between a first cable end and a second cable, the terminator comprising:

a structure defining a cavity that forms a rear volume for the driver of the earbud, the structure envelopes and is fixed to only a portion of the earbud cable, wherein the portion of the earbud cable is between the first cable end and the second cable end; and a cutout of the structure providing access to the first cable end of the earbud cable outside of the cavity.

24. The terminator of claim 23, wherein a perimeter of the structure fits around a rear portion of the driver.

25. The terminator of claim 23, wherein the cutout of the structure provides the access to the first cable end of the earbud cable outside of the cavity for coupling the driver to the first cable end of the earbud cable outside of the cavity.

26. The terminator of claim 23, wherein the cavity is substantially hemispherical.

27. The terminator of claim 23, wherein the portion of the earbud cable comprises tensile members that are tied in a knot.

28. The earbud of claim 1, wherein the rear housing comprises a snap that is directly mated to a snap of the cap.

* * * * *